US010478647B2

(12) United States Patent
Murray et al.

(10) Patent No.: US 10,478,647 B2
(45) Date of Patent: Nov. 19, 2019

(54) STOVETOP FIRE SUPPRESSOR WITH SHUTTLE ACTUATOR AND METHOD

(71) Applicants: Donald W Murray, Arlington, TX (US); Richard M Anthony, River Oaks, TX (US)

(72) Inventors: Donald W Murray, Arlington, TX (US); Richard M Anthony, River Oaks, TX (US)

(73) Assignee: Williams RDM, Inc, Fort Worth, TX (US)

( * ) Notice: Subject to any disclaimer, the term of this patent is extended or adjusted under 35 U.S.C. 154(b) by 174 days.

(21) Appl. No.: 14/689,602

(22) Filed: Apr. 17, 2015

(65) Prior Publication Data

US 2016/0151652 A1 Jun. 2, 2016

Related U.S. Application Data

(60) Provisional application No. 62/085,326, filed on Nov. 27, 2014.

(51) Int. Cl.
*A62C 3/00* (2006.01)
*A62C 35/08* (2006.01)

(52) U.S. Cl.
CPC ..... *A62C 3/006* (2013.01); *A62C 35/08* (2013.01)

(58) Field of Classification Search
CPC ..... A62C 3/006; A62C 35/08
USPC ..... 169/46, 37–42, 90, 28, 29, 65
See application file for complete search history.

(56) References Cited

U.S. PATENT DOCUMENTS 1,063,228 A * 6/1913 Thornton ..... A62C 35/605 169/26
1,411,903 A * 4/1922 Bett ..... A62C 37/10 169/40
1,489,703 A * 4/1924 Johnson ..... A62C 35/605 169/28
3,040,815 A 6/1962 Pambello
3,209,837 A 10/1965 Freedman
3,773,111 A 11/1973 Dunn
3,833,063 A 9/1974 Williams
3,874,458 A * 4/1975 Williams ..... A62C 99/0027 169/28
3,874,459 A 4/1975 Williams
(Continued)

FOREIGN PATENT DOCUMENTS

CN 102512777 A * 6/2012

*Primary Examiner* — Darren W Gorman
(74) *Attorney, Agent, or Firm* — Morani Patent Law, PC

(57) ABSTRACT

An automatic stovetop fire suppressor is activated by a shuttle actuator. The self-contained and closed container device provides a gradual release of a fire suppressing agent in a desired distribution pattern. A method of reliable and spatial agent release are provided herein. A plastic cone shaped lid seals on the bottom of a can and forms a closed container. The closed container is filled with a fire suppressing agent. An initiator charge is housed external to the container of fire suppressing agent and is fuse activated. The activated charge displaces the shuttle. As the shuttle displaces, vertical support for the bottom cone lid is removed and a compression spring breaks a circumferential seal between the bottom lid and container cylindrical sidewall and lowers the bottom lid exposing a radial opening. Fire suppressing agent flows out of the radial opening, suppressing a stovetop fire.

17 Claims, 16 Drawing Sheets

(56) References Cited

U.S. PATENT DOCUMENTS

| | | | | | |
|---|---|---|---|---|---|
| 3,884,306 | A * | 5/1975 | Williams | A62C 3/006 169/28 |
| 3,884,307 | A * | 5/1975 | Williams | A62C 3/006 169/28 |
| 3,897,826 | A | 8/1975 | Glover | |
| 3,918,526 | A | 11/1975 | Hattori | |
| 4,011,911 | A | 3/1977 | Gow | |
| 4,023,494 | A | 5/1977 | Barton | |
| 4,113,020 | A | 9/1978 | Panetta | |
| 4,256,181 | A | 3/1981 | Searcy | |
| 4,485,741 | A | 12/1984 | Moore | |
| 4,553,602 | A * | 11/1985 | Pieczykolan | A62C 37/12 169/19 |
| 4,813,487 | A | 3/1989 | Mikulec | |
| 4,964,469 | A | 10/1990 | Smith | |
| 5,297,636 | A | 3/1994 | North | |
| 5,351,760 | A | 10/1994 | Tabor | |
| 5,375,523 | A | 12/1994 | Morris | |
| 5,518,075 | A * | 5/1996 | Williams | A62C 35/08 169/28 |
| 5,628,367 | A | 5/1997 | Traux et al. | |
| 5,868,205 | A | 2/1999 | Cunningham et al. | |
| 5,871,057 | A | 2/1999 | Stehling et al. | |
| 5,881,819 | A | 3/1999 | Walters et al. | |
| 5,899,278 | A | 5/1999 | Mikulec | |
| 6,029,751 | A | 2/2000 | Ford et al. | |
| 6,105,677 | A | 8/2000 | Stager | |
| 6,244,353 | B1 | 6/2001 | Greer | |
| 6,276,461 | B1 | 8/2001 | Stager | |
| 6,796,382 | B2 | 9/2004 | Kaimart | |
| 7,182,143 | B2 | 2/2007 | Hall et al. | |
| 7,472,758 | B1 | 1/2009 | Stevens | |
| 7,610,966 | B1 | 11/2009 | Weintraub et al. | |
| 7,934,564 | B1 | 5/2011 | Stell et al. | |
| 7,969,296 | B1 | 6/2011 | Stell | |
| 8,294,567 | B1 | 10/2012 | Stell | |
| 8,517,117 | B2 | 8/2013 | Mikulec | |
| 2009/0071664 | A1 * | 3/2009 | Sitabkhan | A62C 37/12 169/57 |
| 2013/0175058 | A1 * | 7/2013 | Williams | A62C 35/08 169/46 |

* cited by examiner

STOVETOP FIRE SUPPRESSOR WITH SHUTTLE ACTUATOR AND METHOD

CROSS REFERENCE TO RELATED APPLICATIONS

This application claims priority to U.S. Provisional Application No. 62/085,326, filed 27 Nov. 2014, the contents of which are incorporated herein by reference.

FIELD OF THE INVENTION

The present invention relates to a device and method of fire suppression, and more particularly to an automatic stovetop fire suppressor.

BACKGROUND OF THE INVENTION

Stovetop fires are a well-known residential and commercial hazard. An unattended stovetop fire, for example a grease fire, can cause damage to nearby appliances and cabinets. Worse, stovetop fires can lead to structural damage or injury. Because the propensity for stovetop fires is so pervasive, an efficient means of automatic fire suppression is desired. Even if a stovetop fire is attended, an automatic extinguishing method may be more effective and expedient compared to manual means.

A number of conventional automatic stovetop fire extinguishers, which mount above the stovetop surface, are available. These include: U.S. Pat. No. 6,276,461 to Stager; U.S. Pat. No. 6,105,677 to Stager; U.S. Pat. No. 5,899,278 to Mikulec; U.S. Pat. No. 7,472,758 to Stevens and Weintraub; U.S. Pat. No. 7,610,966 to Weintraub et al; U.S. Pat. No. 5,518,075 to Williams; and U.S. Pat. No. 3,884,307 to Williams. The array of conventional fire suppression systems vary from pendulum swing apparatus (Stager '461), to canister systems (Williams '307 and Stager '677), or to tube connecting systems for liquid effluent (Mikulec '278). The array of conventional fire suppression systems vary from activation by melting of a fusible pin (Stager '461), to melting a solder fusible plug (Stager '677), to burning of a fuse (Williams '307, Stevens '758), or to activating via a glass bulb fuse mechanism (Mikulec '278).

In conventional stovetop fire suppressor methods the release of the fire suppressing agent may occur in a single burst. In a stovetop fire condition, it may be desirable to provide a controlled release of a fire suppressing agent both in a pattern of distribution of the agent and in the release of the agent as a function of time. At the same time, it would desirable to maintain a rapid and reliable response to a fire condition.

SUMMARY OF THE INVENTION

The present invention addresses some of the issues presented above by providing a controlled release of a fire suppressing agent in an automatic stovetop fire suppressor. Aspects of the present invention are provided for summary purposes and are not intended to be all inclusive or exclusive. Embodiments of the present invention may have any of the aspects below.

Conventionally, a fire suppressing agent deploys in a bulk release upon rupture of metal segments. It may be desirable to provide a gradual release of fire suppressing powder or powder-like agent over time. A gradual release over time may enable decreased or eliminated splash of liquid on the stovetop, which may be burning cooking oil. Further, a broader or directed distribution of the released fire suppressing agent may be desired.

In part, by departing from an activation process that includes the rupture of metal segments in a bottom container wall and by implementing an activation process which incorporates the release of compressed spring energy to deploy, to lower, a bottom lid, the present invention can employ a shuttle displacement actuator.

One aspect of the present invention is to provide a user friendly method of suppressing a stovetop fire.

Another aspect of the present invention is to provide an automated release of fire suppressing agent in the presence of a stovetop fire.

Another aspect of the present invention is to provide a flow of fire suppressing agent upon activation of the stovetop fire suppressor.

Another aspect of the present invention is a mounting device and method which affords full and proper function of a stovetop fire suppressor mounted beneath a vent hood.

Another aspect of the present invention is to provide a convenient mounting device for a micro-hood stovetop environment.

Yet another aspect of the present invention is to provide a consistent release of fire suppressing agent upon activation of the stove top fire suppressor.

Another aspect of the present invention is to provide a gradual release of fire suppressing agent over time.

Another aspect of the present invention is to provide a desired distribution pattern of fire suppressing agent in a fire condition.

Another aspect of the present invention is to provide a closed fire extinguishing container in an inactivated state.

Yet another aspect of the present invention is to provide a stovetop fire suppressor using a combination of ready-made and custom made parts.

Another aspect of the present invention is relative ease of use in employment of the present invention in field applications.

Another aspect of the present invention is a method of releasing the fire suppressing agent upon lowering of the bottom lid.

Another aspect of the present invention is lowering of the bottom lid by the displacement of a shuttle actuator.

Another aspect of the present invention is triggering displacement of the shuttle actuator using an actuator charge.

Another aspect of the present invention is using a dual fuse to activate the actuator charge.

Another aspect of the present invention is a bottom surface on a center shaft, a lower headed pin, or nail to support the vertical position of the shuttle.

Another aspect of the present invention is catching of a bottom of a center guide of the container bottom lid on an inner shuttle housing surface upon actuation of the fire suppressor device.

Another aspect of the present invention is securing a center shaft, or nail, to a top wall of the container for the fire suppressing device.

Another aspect of the present invention is extension of a compressed spring upon shuttle displacement lowering the bottom lid, breaking a container seal, and opening the fire suppressor device.

Still another aspect of the present invention is the use of plastic for the bottom lid of the fire suppressor container.

Still another aspect of the present invention is a center guide bushing attached to or integral to the lower bottom lid.

Still another aspect of the present invention is a center post attached to or integral to the upper wall of the container.

Still another aspect of the present invention is a center guide bushing surrounding a center post, and the center post surrounding a center shaft, the center shaft spanning the height of the fire suppressor device.

Another aspect of the present invention is the containment of the fire suppressing agent in a closed container from manufactured end to activation of the device in a fire condition.

Still another aspect of the present invention is the use of a fuse for activation of the fire suppressing device.

Another aspect of the present invention is the use of a reduced charge size, as compared to conventional stovetop fire suppressors, for activation of the fire suppressing device.

Another aspect of the present invention is the ability to vary the distribution pattern of the fire suppressing agent by changing the cone angle of the container bottom lid.

Another aspect of the present invention is the ability to vary the release time of the fire suppressing agent by varying the drop height of the cone lid upon activation.

Another aspect of the present invention is the ability to vary the release time of the fire suppressing agent by varying both the cone angle of the container bottom lid and the drop height of the cone lid upon activation.

Still another aspect of the present invention is the use of thermo-molding to create a custom container bottom lid.

In still another aspect of the present invention, the lid pattern is concave or convex.

Another aspect of the present invention is the ready mounting ability of the fire suppressor above the stovetop.

Still another aspect of the present invention is the use of a plastic custom shuttle that has a charge compartment and a shuttle housing with an integral charge housing.

Still another aspect of the present invention is thermo-molding the shuttle and a charge cup/compartment as an integral component.

Those skilled in the art will further appreciate the above-noted features and advantages of the invention together with other important aspects thereof upon reading the detailed description that follows in conjunction with the drawings.

BRIEF DESCRIPTION OF THE FIGURES

For more complete understanding of the features and advantages of the present invention, reference is now made to the detailed description of the invention along with the accompanying figures, wherein.

DETAILED DESCRIPTION OF THE INVENTION

The invention, as defined by the claims, may be better understood by reference to the following detailed description. The description is meant to be read with reference to the figures contained herein. This detailed description relates to examples of the claimed subject matter for illustrative purposes, and is in no way meant to limit the scope of the invention. The specific aspects and embodiments discussed herein are illustrative of ways to make and use the invention, and are not intended to limit the scope of the invention. Same reference numbers across figures refer to like elements for ease of reference. Reference numbers may also be unique to a respective figure or embodiment.

Figure 1A:
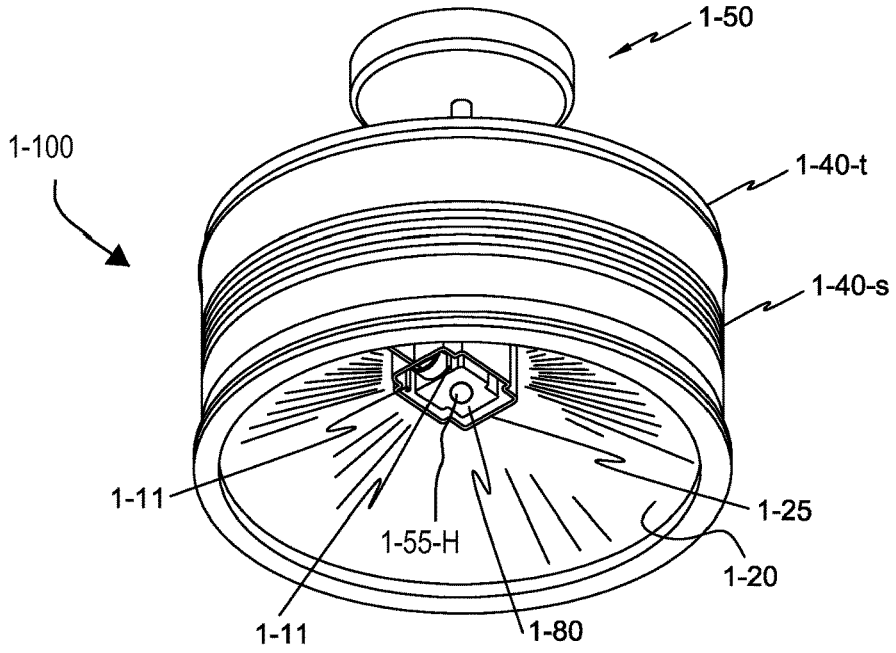
FIG. 1A shows a bottom perspective of an automatic stovetop fire suppressor in a closed state with a cone shaped bottom lid, a fuse, and a shuttle actuator, in accordance with an exemplary embodiment of the present invention.

FIG. 1A shows a bottom perspective of an automatic stovetop fire suppressor in a closed state with a cone shaped bottom lid, a fuse, and a shuttle actuator, in accordance with an exemplary embodiment of the present invention. FIG. 1A shows a cone shaped bottom lid 1-20. Moving towards that center, FIG. 1A shows a shuttle housing 1-80. A splash shield 1-25 surrounds the shuttle housing 1-80 and two ends of a fuse 1-11, 1-11 extend out of the bottom of shuttle housing 1-80 facing the stovetop surface when mounted for fire suppression. The lid 1-20 is sealed to a container sidewall 1-40-S. A mounting assembly 1-50 is connected to the shuttle actuated fire suppressor 1-100 and is shown above a container top wall 1-40-*t*. A mounting assembly 1-50 is attached to the stovetop fire suppressor 1-100 and is shown extending above a top wall 1-40-*t*. The head of the center pin 1-55-H is shown near shuttle housing 1-80 center and secures the shuttle assembly to the fire suppressor.

Figure 1B:
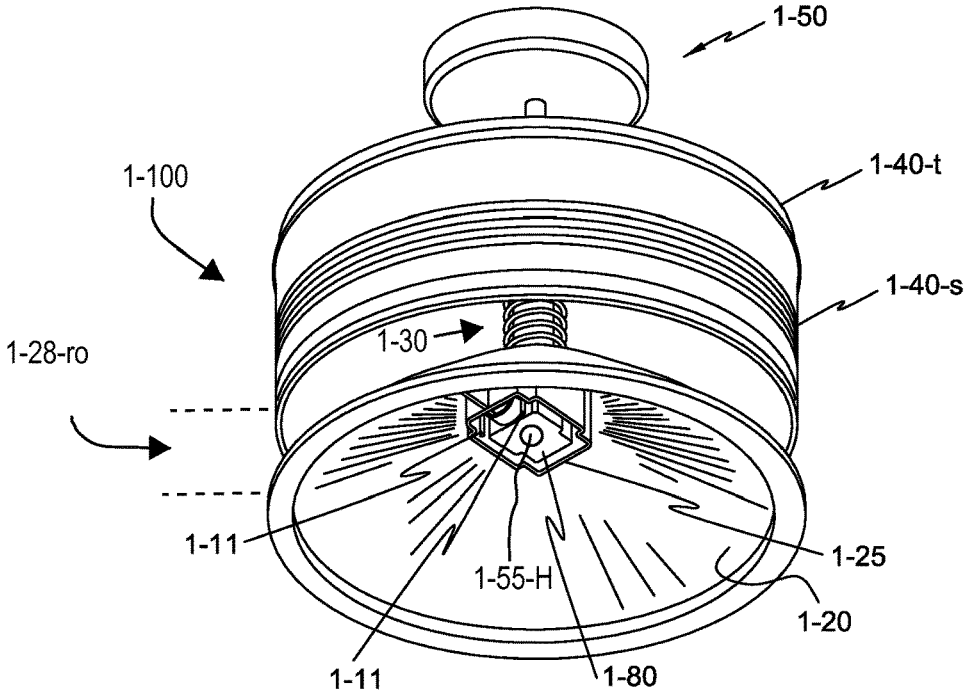
FIG. 1B shows a bottom perspective of an automatic stovetop fire suppressor in an open activated state with a cone shaped bottom lid, a fuse, and a shuttle actuator, in accordance with an exemplary embodiment of the present invention.

FIG. 113 shows a bottom perspective of an automatic stovetop fire suppressor in an open activated state with a cone shaped bottom lid, a fuse, and a shuttle actuation, in accordance with an exemplary embodiment of the present invention. FIG. 1B shows the bottom lid 1-20 dropped below sidewall 1-40-S forming a radial opening 1-28-*ro*. Seen through the opening is a spring 1-30. The spring is compressed in the closed state of the fire suppressor but when the fuse lights and the shuttle displaces the support holding the spring in compression, the spring expands to break the seal between the lid circumference and the cylindrical sidewall and to lower the cone shaped bottom lid. Fire suppressing powder flows out of the radial opening 1-25-*ro* when the shuttle actuated stovetop fire suppressor 1-100 activates, as shown in FIG. 1B. The splash guard 1-25 and shuttle housing 1-80 remain in their same position relative to the cone shaped bottom lid 1-20. The center pin head 1-55-H is shown near the shuttle housing center 1-80. A mounting assembly 1-50 secures the fire suppressor above the stovetop surface in practice. Two ends of a fuse 1-11, 1-11 extend from the shuttle housing 1-80.

Figure 2:
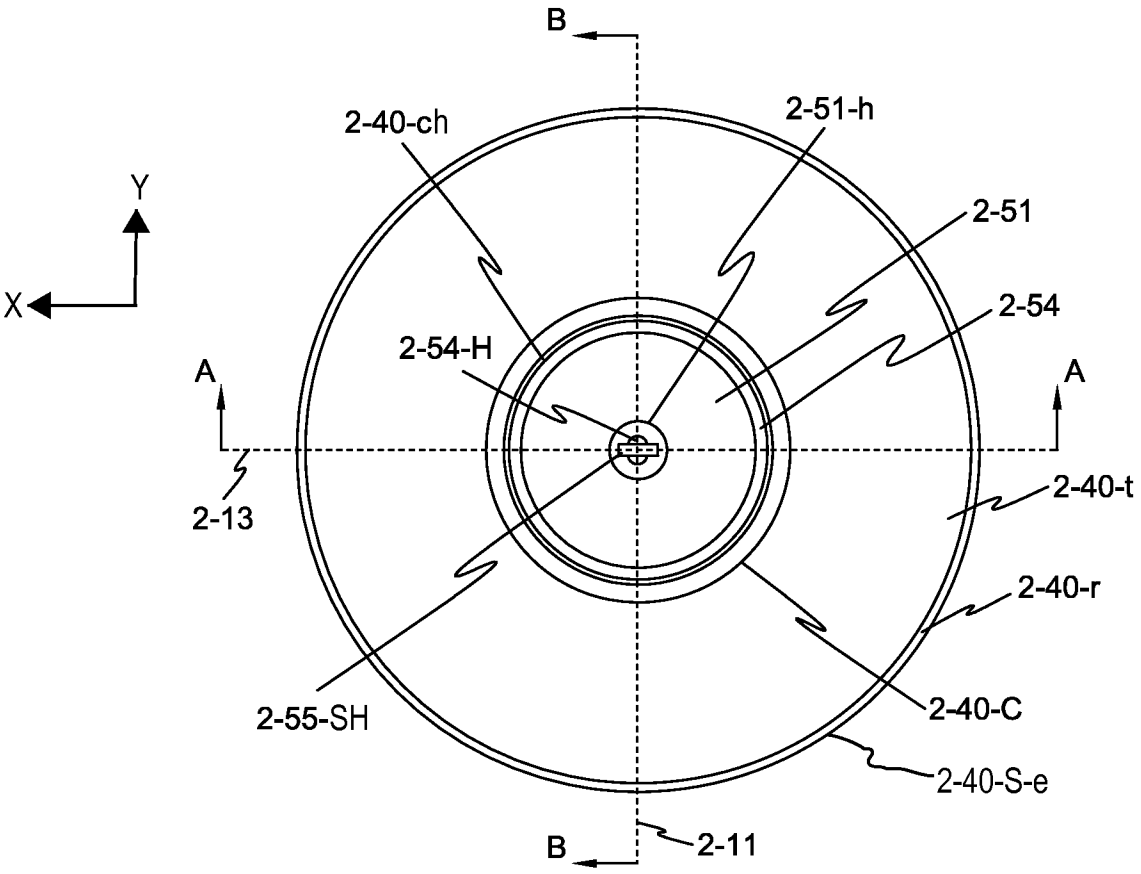
FIG. 2 shows a top view of a stovetop fire suppressor, in accordance with an exemplary embodiment of the present invention.
Figure 3A:
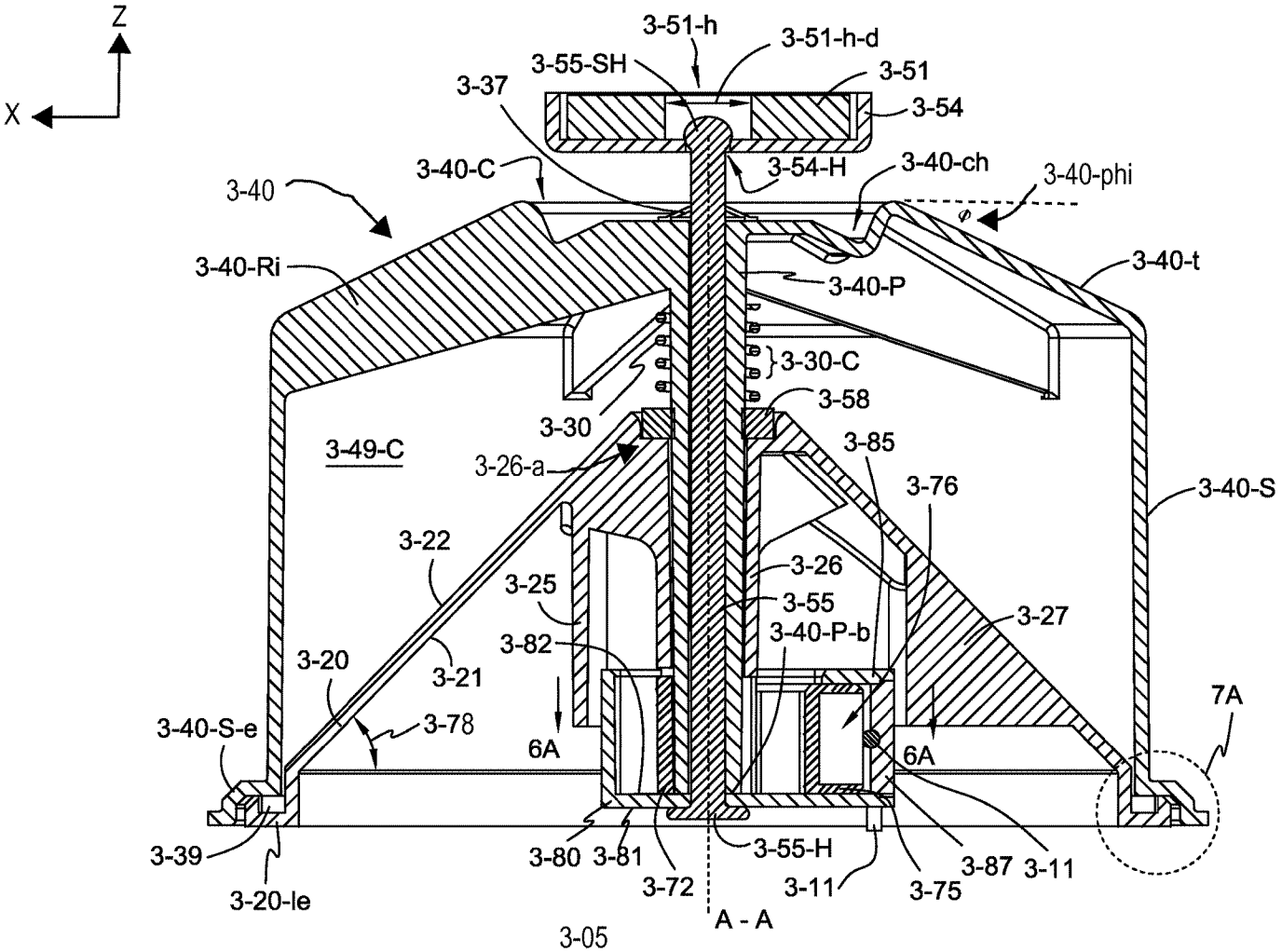
FIG. 3A shows a cross sectional view taken along line A-A of FIG. 2 of a stovetop fire suppressor in a closed state, in accordance with an exemplary embodiment of the present invention.
Figure 3B:
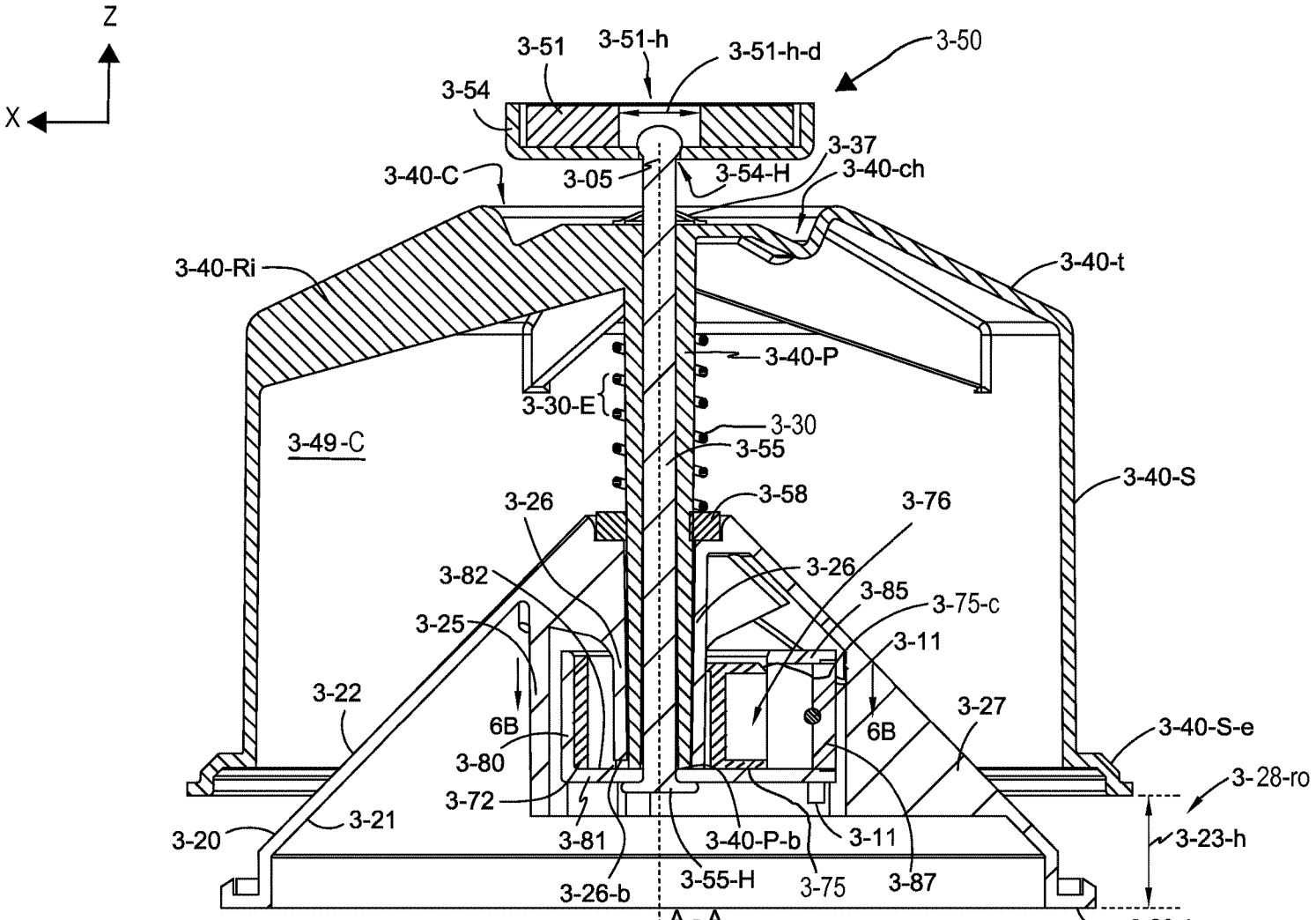
FIG. 3B shows a cross sectional view taken along line A-A of FIG. 2 of a stovetop fire suppressor in an open activated state, in accordance with an exemplary embodiment of the present invention.
Figure 5:
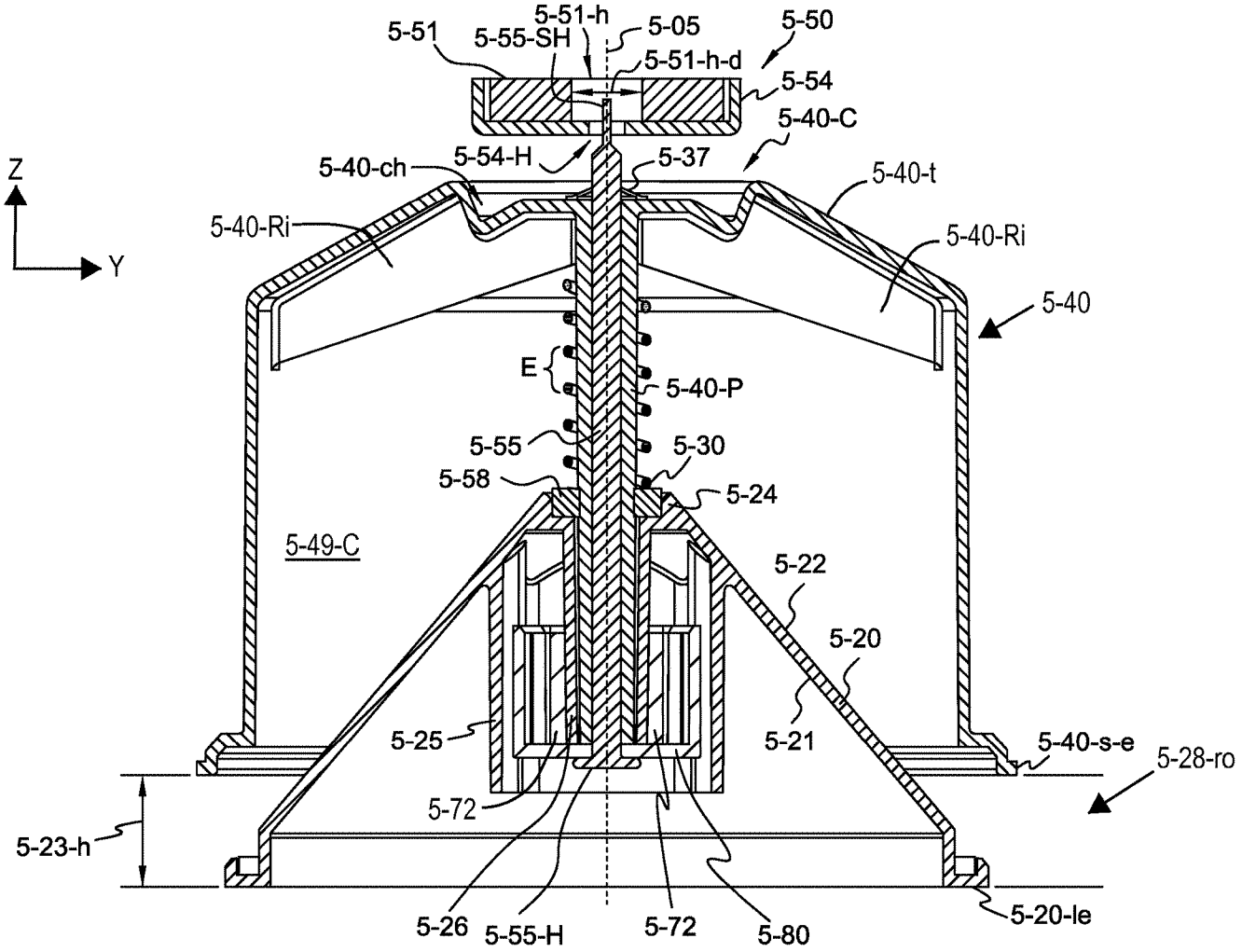
FIG. 5 shows a cross sectional view taken along line B-B of FIG. 2 of a stovetop fire suppressor in an open activated state, in accordance with an exemplary embodiment of the present invention.

FIG. 2 shows a top view of a stovetop fire suppressor, in accordance with an exemplary embodiment of the present invention. Parts of the mounting assembly are shown around the center, where cross sectional view lines A-A 2-13 and B-B 2-11 intersect. From the inside, a shoulder of the center pin 2-55-SH is shown extending across a magnet housing hole 2-54-H and within a center hole a magnet 2-51-*h*. A donut shaped magnet 2-51 is mounted in magnet housing 2-54. The magnet housing 2-54 fits within a cup 2-40-C in the top wall. Between cup 2-40-C and magnet housing 2-54 is cup channel 2-40-*ch*. The cup 2-40-C, the cup channel 2-40-*ch* and the magnet housing 2-54 are described in greater detail with reference to, for example, FIGS. 3A and 3B. FIGS. 3A and 3B show a cross sectional view along line A-A 2-13 of FIG. 2. And FIG. 5 shows an orthogonal cross sectional view along line B-B 2-11 of FIG. 2. Referring again to FIG. 2, the top wall 2-40-*t* extends outward and rolls 2-40-*r* into a sidewall, where an outer sidewall edge 2-40-S-e is shown. The outer edge of the side wall 2-40-S-e is shown in more detail in, for example, FIGS. 7A and 7B.

FIG. 3A shows a cross sectional view taken along line A-A of FIG. 2 of a stovetop fire suppressor in a closed state, in accordance with an exemplary embodiment of the present invention. This cross sectional view shows the cross section for the XZ plane at axial center. The container or can 3-40 of the stovetop fire suppressor has a top wall 3-40-*t* and a cylindrical side wall 3-40-*s*. As shown in the embodiment of FIG. 3A, the can top wall 3-40-*t* may be slanted 3-40-*phi* with respect to the horizontal plane X-Y. The can has an integral cylindrical hollow post 3-40-P which begins from the top wall 3-40-*t*, is centered with respect to the top wall, and extends down into the can. The center post 3-40-P is symmetrical across center line 3-05 in the cross sectional view of line A-A. A compression spring 3-30 surrounds the center post 3-40-P. FIG. 3A shows a stovetop fire suppressor in the closed position, in turn, spring 3-30 is in a compressed 3-30-C state. Spring 3-30 extends from a top inner surface of a top wall rib 3-40-Ri and a lid 3-20. In accordance with an exemplary embodiment the center post 3-40-P and rib 3-40-Ri are integral to the top wall. In alternate embodiments, they are separate pieces but secured to the top wall. In accordance with the exemplary embodiment of FIG. 3A, there are three ribs 3-40-Ri, each separated by 120 degrees.

FIG. 3A shows a cone shaped bottom lid 3-20 with an inner side 3-22 and an outer side 3-21. Integral to the cone shaped lid 3-20 is a cylindrical center guide 3-26. The center guide 3-26 is centered in the XY plane of the lid and is open in the Z direction. The center guide 3-26 surrounds a bottom portion of center post 3-40-P. The inner diameter of the center guide 3-26 affords easy movement up and down about the outer diameter of center post 3-40-P. In accordance with the exemplary embodiment of FIG. 3A, a washer 3-58, for example a felt washer, sits in washer seat 3-26-*a*, which is disposed in a top side of the center guide 3-26. Felt washer 3-58 surrounds the center post 3-40-P.

In accordance with an alternate embodiment, the center guide is a separate piece but is secured to the cone shaped bottom lid. Referring again to FIG. 3A, in accordance with the exemplary embodiment, there is a splash guard 3-25 which surrounds the sides in the XZ and YZ planes of the shuttle housing 3-80. In accordance with the exemplary embodiment of FIG. 3A, the splash guard is integral to the lid and an attachment 3-27 of the splash guard 3-25 to the lid 3-20 is shown in this cross section view. The center guide 3-26 extends down to shuttle 3-72. Shuttle 3-72 is further described with reference to FIGS. 6A-6D, below. Shuttle 3-72 sits upon inner surface 3-82 of shuttle housing 3-80. Turning to the shuttle 3-72, the shuttle has a charge cup 3-75 forming a charge compartment 3-76 at a fuse 3-11 end. The charge cup 3-75 fits inside a charge housing 3-85. The charge housing 3-85 is integral to the shuttle housing 3-80. Also shown is a cap 3-87, which seals the open end of the charge housing 3-85, and a fuse which fits between the cap 3-87 and the charge compartment 3-76. The charge cup 3-75 and the charge housing 3-85 open to the positive XZ plane. The charge cup has a backwall towards the negative XZ plane. The charge compartment and charge housing are also shown in and described with reference to FIG. 4. The center post extends down 3-40-P-b to rest on an inner 3-82 surface of shuttle housing 3-80.

The cone shaped bottom lid 3-20 has an angle 3-76; this angle may be 20 degrees, in accordance with an exemplary embodiment. The outer circumferential lid edge 3-20-*le* and the bottom edge of the container sidewall 3-40-S-e is shown in greater detail in FIG. 7A. A small seal 3-39 is also shown disposed between the sidewall edge 3-40-S-e and the outer lid edge 3-20-*le*. Lines 6A-6A show the view taken for FIG. 6A.

Through the center of the fire suppressor from the shuttle housing 3-80, through the center post 3-40-P, out the top wall 3-40-*t* and into the magnet housing 3-54 is the center pin 3-55. The center pin has a head 3-55-H which has a diameter greater than the opening in the shuttle housing 3-80. As the shaft of the center pin 3-55 exits the top wall 3-40-*t*, a push nut 3-37 secures the container 3-40 and lid 3-20 in its closed in activated state. In accordance with alternate embodiments, alternate center shafts and fasteners can be used in combination to secure the can 3-40 to the lid 3-20. Alternate shafts may include L shaped rods of cotter pins.

A fire suppressing agent, not shown, is stored in a can interior space 3-49-*c*.

In assembly, the center pin 3-55 has a head 3-55-H in the negative Z position but is straight or pointed at its positive Z end. The positive Z end of the center pin is shown passing through magnet housing 3-54 hole 3-54-H and then flattened within the diameter 3-51-*h*-*d* of the hole 3-51-*h* of the donut shaped magnet 3-51. In application a fire suppressor may mount to, for example, a vent hood. In accordance with embodiments of the present invention, mounting devices may afford pivoting of the stovetop fire suppressor such that the bottom lid hangs parallel to the horizontal cooking surface even when the mounting surface is tilted to the horizontal XY plane.

FIG. 3B shows a cross sectional view taken along line A-A of FIG. 2 of a stovetop fire suppressor in an open activated state, in accordance with an exemplary embodiment of the present invention. Here the lid 3-20 has separated from the cylindrical sidewall 3-40-*s*. More particularly, lid 3-20 has dropped below a side wall edge 3-40-S-*e* by a drop height of 3-23-*h*. Shuttle 3-72 has moved in the X direction and center guide 3-26 has dropped. A lower surface 3-26-*b* of the center guide 3-26 rests upon an inner side of housing 3-82. The fuse 3-11 is shown for illustrative purposes. In practice, the fuse lights and a charge, not shown, ignites displacing the shuttle 3-72 into the position shown. The drop height 3-23-*h* is shown from a bottom edge 3-40-S-e of the side wall 3-40-S to the lid edge 3-20-*le*. Spring 3-30 is shown in its extended, less compressed, state 3-30-E. The spring 3-30 extends from a top inner surface of the ribs 3-40-Ri to felt washer 3-58. The felt washer 3-58 is disposed atop center guide 3-26. Center guide 3-26 is integral to the cone shaped bottom lid 3-20, in accordance with the exemplary embodiment shown in FIG. 3B.

Figure 6B:
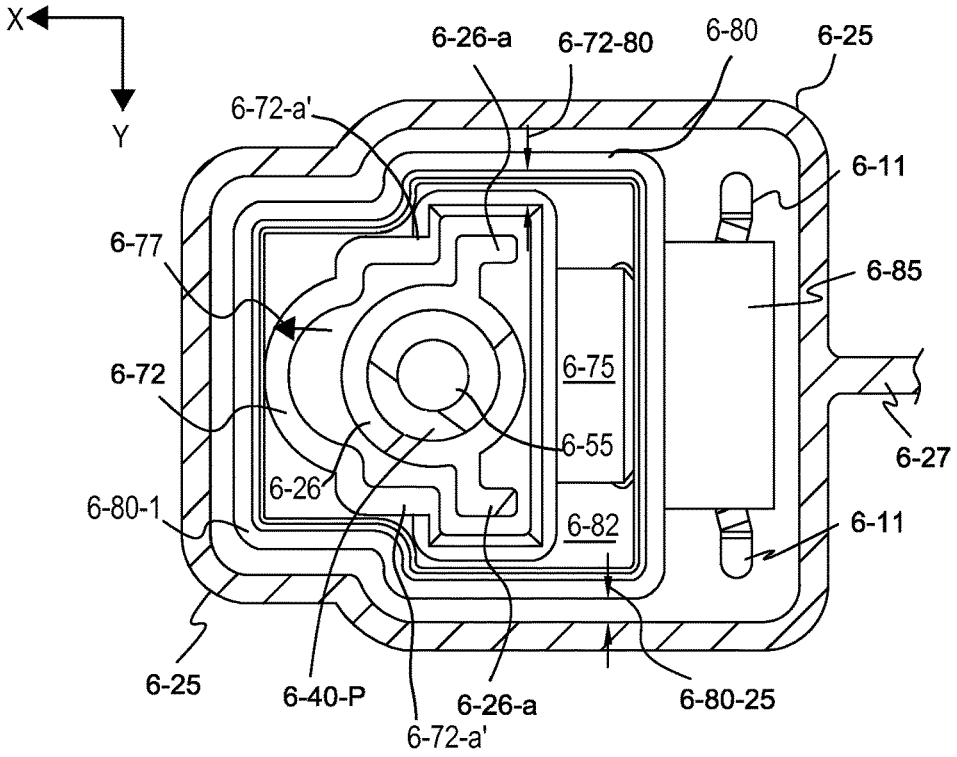
FIG. 6B shows a cross sectional view taken along line 6B-6B of FIG. 3B of a shuttle assembly of a stovetop fire suppressor in an open activated state, in accordance with an exemplary embodiment of the present invention.

In the open activated state of FIG. 3B, the charge has ignited via the fuse. In accordance with an exemplary embodiment, the spring 3-30 may be a helical compression spring. It may have a free length of 1.5 inches and a load rate of 6.0 lbs/inch. The spring may be zinc plated steel and have a wire diameter of 0.05 inches. Referring again to FIG. 3B, fire suppressing powder stored in a can interior 3-49-C flows out of the radial opening 3-28-*ro*. The charge cup 3-75 of the shuttle may have a chamfered top side 3-75-*c* on a top at its opening, in accordance with an exemplary embodiment, or may have a chamfered circumference in an alternate embodiment. Cap 3-87 is secured to charge housing 3-85 of the shuttle housing 3-80. In accordance with the exemplary embodiment of FIGS. 3A and 3B, the splash guard 3-25 which surrounds the sides in the XZ and YZ planes of the shuttle housing 3-80 is lowered to just below the shuttle housing's position in the Z direction upon activation and lowering of the lid 3-20. The view lines for FIG. 6B are also shown in FIG. 3B.

The charge housing 3-85 of the shuttle housing 3-80 remains in its inactivated position. The center pin 3-55 remains attached to the mounting assembly 3-50, anchoring the fire suppressor in position above the stovetop. The clearance between shaft of center pin 3-55 and magnet housing hole 3-54-H in combination with the cup 3-40-C in the top wall 3-40-*t* and the cup channel 3-40-*ch* afford a tilting of the fire suppressor with respect to the mounting assembly 3-50. As above, the positive Z end of the center pin is shown passing through magnet housing 3-54 hole 3-54-H and then flattened within the diameter 3-51-*h*-*d* of the hole 3-51-*h* of the donut shaped magnet 3-51. At the opposite end of the center pin 3-55, an outer side 3-81 of the shuttle housing 3-80 rests on the head 3-55-H of the center pin 3-55.

Figure 4:
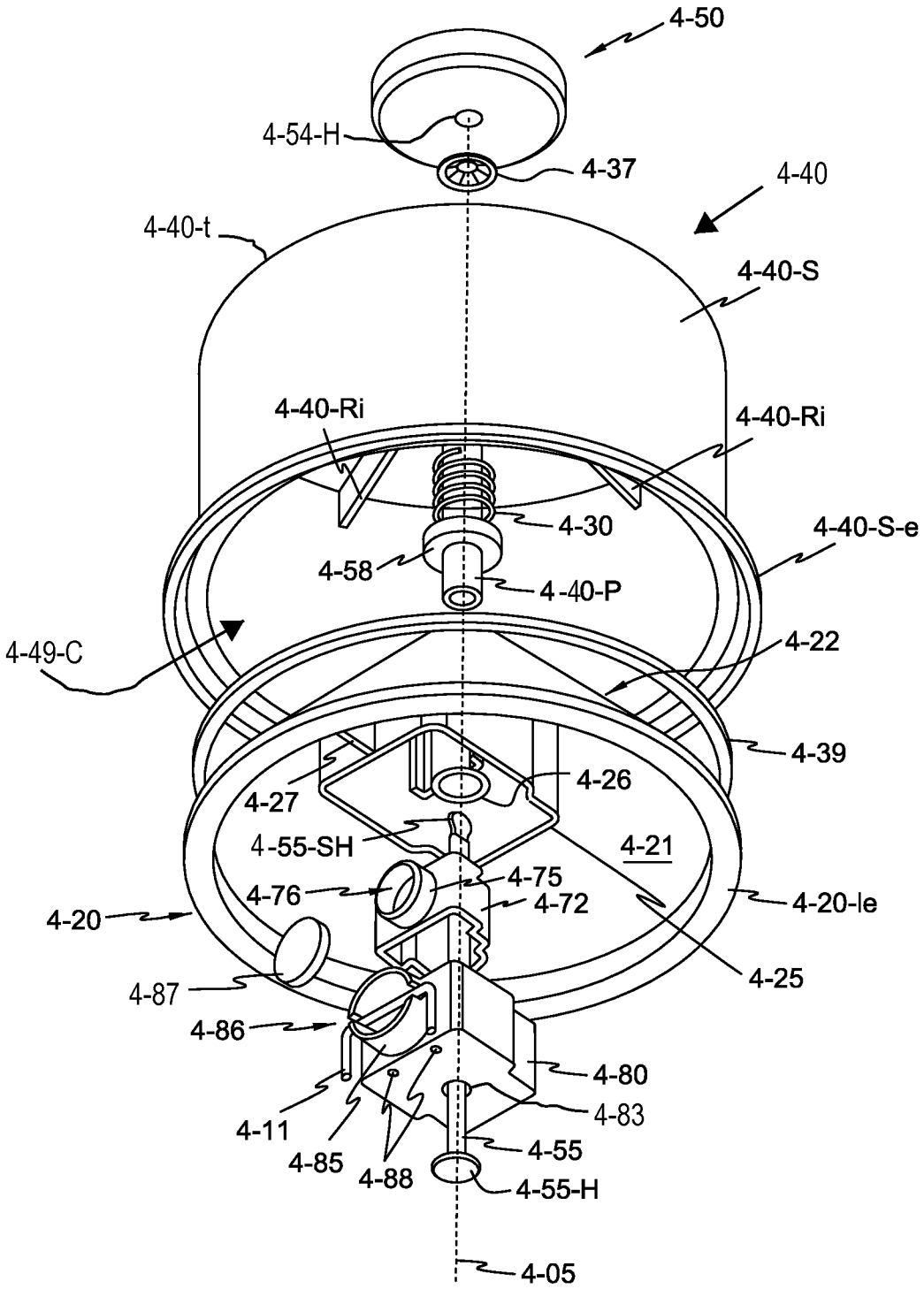
FIG. 4 shows an exploded view of a shuttle actuated fire suppressor device in three dimensions from a bottom perspective, in accordance with an exemplary embodiment of the present invention.

FIG. 4 shows an exploded view of a shuttle actuated fire suppressor device from a bottom perspective, in accordance with an exemplary embodiment of the present invention. An outer side 4-21 of the cone lid 4-20 faces the negative Z direction in the present view, while an inner side 4-22 faces into the can 4-49-C. The container has a top wall 10-40-*t* and integral sidewalls 10-40-*s*. Ribs 4-40-Ri, also shown inside the can 4-49-C, provide structural support. In accordance with an exemplary embodiment, ribs may be integral to the top wall 10-40-*t* of the can 4-40 and/or to the side wall 4-40-*s*. In accordance with an exemplary embodiment, there are three ribs spaced 120 degrees apart. In accordance with another exemplary embodiment, the cylindrical sidewall 4-40-S maybe corrugated to increase, for example, stiffness and to keep the cylindrical shape and maintain the lid to sidewall interface/seal.

In accordance with the exemplary embodiment of FIG. 4, an off the shelf nail serves as the center pin 4-55 with a head 4-55-H and is configured as further described below during assembly. The center pin 4-55 fits inside a bottom hole 4-83 of the shuttle housing 4-80 with the pin head 4-55-H having greater diameter than the bottom hole 4-83.

Also shown in FIG. 4 are two vent holes 4-88 in the bottom of the shuttle housing 4-80. The shuttle housing 4-80 has a hollow cylinder 4-85 which serves as the charge housing. A notch 4-86 is cut across a diameter of the cylinder 3-85. The notch secures the fuse 4-11 in place. Shuttle 4-72 fits inside shuttle housing 4-80, when the fire suppressor is assembled. Before the placing the shuttle 4-72 into its housing 4-80, a charge is secured in the compartment 4-76 of the charge cup 4-75 of the shuttle 4-72. The charge filled shuttle charge cup 4-75 is pushed into charge housing 4-85 and a cap 4-87 closes the charge housing 4-85.

The shuttle assembly of shuttle 4-72 and shuttle housing 4-80 fits within a splash guard 4-25. As the shuttle assembly is raised to the bottom lid 4-20 a center guide 4-26, integral to or affixed to, the lid 3-20 meets upon a corresponding top surface portion of the shuttle 3-80. This interface is shown in greater detail in, for example, FIG. 6A, and further described with reference to the same. A seal 4-39 fits between a lid edge 4-20-*le* and the sidewall bottom edge 4-40-S-e as the lid 4-20 closes to the can forming a closed container.

Shown in the can interior 4-49-C and extending down from the top wall 4-40-*t* is the center post 4-30-P. In accordance with an exemplary embodiment the center post 4-30-P is integral to the can 4-40 and in an alternate embodiment a center post is affixed to the top wall 4-40-*t*. A washer 4-58 is shown around the post 4-40-P and below a compression spring 4-30. The compression spring 4-30 circumscribes the center post 4-40-P. The center post fits within the hollow center of the center guide 4-26 and when the fire suppressor is closed the center posts meets the bottom inner side of the shuttle housing as shown and described with reference to FIGS. 3A and 3B.

Referring again to FIG. 4, the center pin 4-55 is shown with shoulder 4-55-SH formed. In practice the shoulder is formed during assembly of the fire suppressor. The shaft of the center pin 4-55 rises through the shuttle housing hole 4-83 through the shuttle 4-72, through center guide 4-26, through the center post 4-40-P and exits out of the top wall 4-40-*t*. A push nut 4-37 is lowered and the stovetop container is held closed between the push nut and the head of the center pin 4-55-H. The shaft then passes through the hole in the magnet housing 4-54-H and is flattened to extend past the magnet housing hole diameter but to stay within the inner hole of the magnet, not shown. The container 4-40 is mounted above the stove top via the mounting assembly 4-50. The center pin 4-55 rises through axial center 4-05 of the stovetop fire suppressor.

FIG. 5 shows a cross sectional view taken along line B-B of FIG. 2 of a stovetop fire suppressor in an open activated state, in accordance with an exemplary embodiment of the present invention. FIG. 2 shows a top view of a stovetop fire suppressor with shuttle actuator, in accordance with an exemplary embodiment of the present invention with cross section view lines B-B 2-11 and A-A 2-13 at right angles in the XY plane. Turning to FIG. 5, the cross sectional view of a stovetop fire suppressor with shuttle actuation, in accordance with an exemplary embodiment of the present invention is shown for the YZ plane at axial center. In its activated state, the lid 5-20 has dropped down by a height 5-23-*h,* forming a radial opening 5-28-*ro*.

In contrast to the shoulder 5-55-SH view in FIG. 3A in the XZ plane, this orthogonal view shows a narrow side of the shoulder 5-55-H, formed after the center pin passes through the hole 5-54-H in the magnetic housing 5-54. The shoulder 5-55-H fits within the magnet hole 5-51-*h;* the magnet 5-51 is secured in the magnet housing 5-54. The magnet hole diameter 5-51-*h*-*d* is greater than the widest part of the shoulder 5-55-SH, while the shoulder width, not shown, is greater than the diameter of the magnet housing hole 5-54-H. The center shaft 5-55 spans the axial center 5-05 of the stovetop fire suppressor. The push nut 5-37 holds the position of the can 5-40 relative to the shaft. A pair of structural support ribs 5-40-Ri are shown in background. In accordance with the exemplary embodiment of FIG. 5, two of three ribs 5-40-Ri are shown with a 120 degree separation between each adjacent pair.

The shuttle 5-72 has displaced, moving in the X direction and the center guide 5-26 has dropped down to the shuttle housing 5-80. The center pin head 5-55-H supports the shuttle housing 5-80. A washer seat 5-24 is formed integral to the cone shaped lid 5-20 and a washer 5-58 is shown disposed in the washer seat 5-24, in accordance with an exemplary embodiment. In accordance with an alternate embodiment, a washer may be used without a washer seat, or the washer may be omitted. The inner side of the lid 5-22 faces the open can interior 5-49-C and in practice, the outer side of the lid 5-21 faces the cooking surface.

The spring 5-30 is shown in its extended E state and spans from the washer 5-58 to the ribs 5-40-Ri in the top wall 5-40-*t*. when the shuttle displaces 5-72, it no longer supports the center guide 5-26 which drops under the load of the compression spring 5-30 till it rests upon the floor of the shuttle housing 5-80. In accordance with an exemplary, embodiment of FIG. 5, the guide is integral to the cone shaped bottom lid 5-20. As the spring 5-30 presses on the lid 5-20 the seal between the side wall edge 5-40-S-e and the lid circumferential edge 5-20-*le* breaks.

Figure 6A:
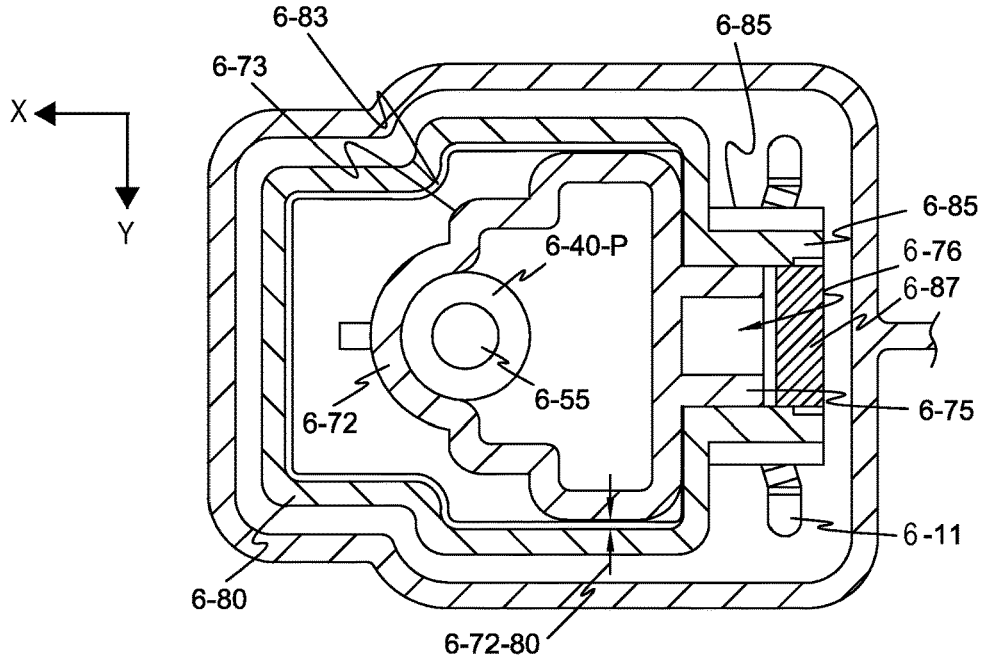
FIG. 6A shows a cross sectional view taken along line 6A-6A of FIG. 3A of a shuttle assembly of a stovetop fire suppressor in a closed state, in accordance with an exemplary embodiment of the present invention.

FIG. 6A shows a cross sectional view taken along line 6A-6A of FIG. 3A of a shuttle assembly in a stovetop fire suppressor in a closed state, in accordance with an exemplary embodiment of the present invention. This view is taken just below, in the negative z direction, of the interface of the center guide and the shuttle. Turning to FIG. 6A, the center post 6-40-P is shown circumscribing the center pin 6-55, the shuttle 6-72 is juxtaposition the center post 6-40-P. A bend 6-3 in the shuttle slips past a rounded corner 6-83 in the shuttle housing. The cap 6-87 for the charge housing 6-85 is shown in its closed position. The fuse 6-11 extends down from the charge housing 6-85. The charge compartment 6-76, formed by the charge cup 6-75 houses the charge, not shown. In accordance with an exemplary embodiment, the charge cup is integral to the shuttle 6-72. The charge cup 6-75 is shown inserted in the charge housing 6-85, in the close position. The view line 6A-6A is FIG. 3A is above the charge housing 3-85. While the view line 6B-6B in FIG. 3B cuts through the charge housing 3-85.

FIG. 6B shows a cross sectional view taken along line 6B-6B of FIG. 3B of a shuttle assembly of a stovetop fire suppressor in an open activated state, in accordance with an exemplary embodiment of the present invention. The charge cup 6-75 of the shuttle 6-72 is shifted out of charge housing 6-85; the charge has ignited and displaced the shuttle 6-72 from under the center guide and from under the spring load, guide and spring not shown. The shuttle 6-72 has shifted in the X 6-77 direction. In accordance with an exemplary embodiment, the shuttle comes into contact on a shuttle housing shorter side 6-80-1. The clearance between the shuttle and shuttle housing 6-72-80 may be nearly constant about the perimeter of the shuttle 6-72. In accordance with an exemplary embodiment the separation may be about 0.05 inches. The clearance of shuttle housing and the splash guard 6-80-25 may vary about the shuttle housing 6-80 perimeter and may be multiple times the separation between the shuttle 6-72 and its housing 6-80. In its open and activated state, the center guide arms 6-26-*a* have lowered to the shuttle housing floor 6-82 from their closed position atop portions 6-72-*a*' of the shuttle 6-72. The center post 6-40-P is shown in the center of the center guide 6-26 and also rests on the floor 6-82 of the shuttle housing 6-80. The center post circumscribes the center pin 6-55. The spash guard 6-25 surrounds the shuttle housing 6-80. The attachment 6-27 affixes the splash guard 6-25 to the lid, not shown. In accordance with an exemplary embodiment, the splash guard is integral to the lid. In accordance with an alternate embodiment, the splash guard is separate but affixed to the lid.

Figure 6C:
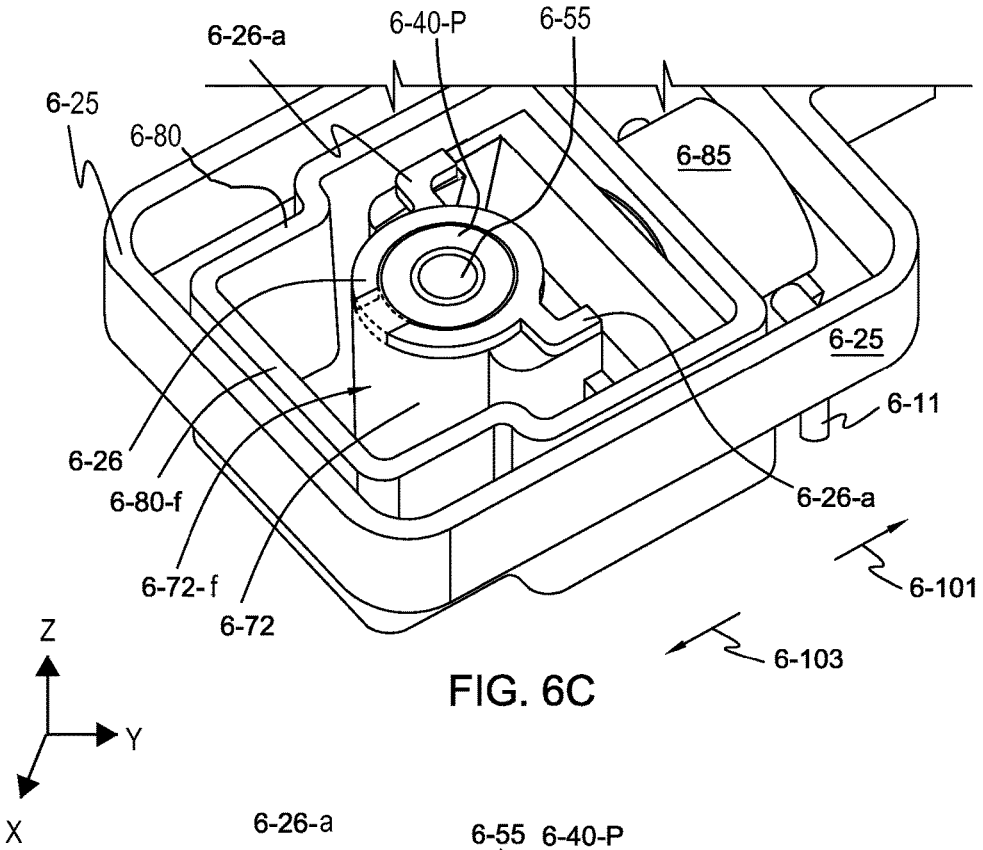
FIG. 6C shows a three dimensional shuttle assembly from a top view in a stovetop fire suppressor in a closed state, in accordance with an exemplary embodiment of the present invention.

FIG. 6C shows a three dimensional shuttle assembly from a top perspective view of a stovetop fire suppressor in a closed state, in accordance with an exemplary embodiment of the present invention. Turning first to the center guide 6-26, a lower most, negative Z direction, slice of the center guide 6-26 is shown sitting atop the shuttle 6-72. The guide arms 6-26-*a* are seated atop the top side, positive Z direction, of the shuttle 6-72. The phantom lines in the center guide 6-72, above the front 6-72-*f* of the shuttle are shown for illustrative purposes; the center guide 6-26 is solid, as shown in, for example FIG. 6D. Referring again to FIG. 6C, the front of the shuttle housing 6-80-*f* is shown in front of, but displaced and separate from, the front of the shuttle 6-72-*f*. The shuttle housing 6-80 surrounds the shuttle 6-72 and has a charge housing 6-85. In the closed configuration a shuttle cup, not shown, integral to the shuttle 6-72 slips aft 6-101 into the charge housing 6-85. The fuse 6-11 extends across a slot in the charge housing. A cap, not shown, fits into the charge housing and closes the charge housing 6-85. The splash guard 6-25 is shown surrounding the shuttle housing 6-80, to include the charge housing 6-85 and fuse 6-11, in accordance with the exemplary embodiment of FIG. 6C. As the stovetop fire suppressor is activated, the shuttle moves forward 6-103, into the position shown in FIG. 6D. Referring again to FIG. 6C, the center post 6-40-P is shown circumscribing the bottom most part, negative Z direction, of the center guide 6-26. The center pin 6-55 is centered in the center post 6-40-P.

Figure 6D:
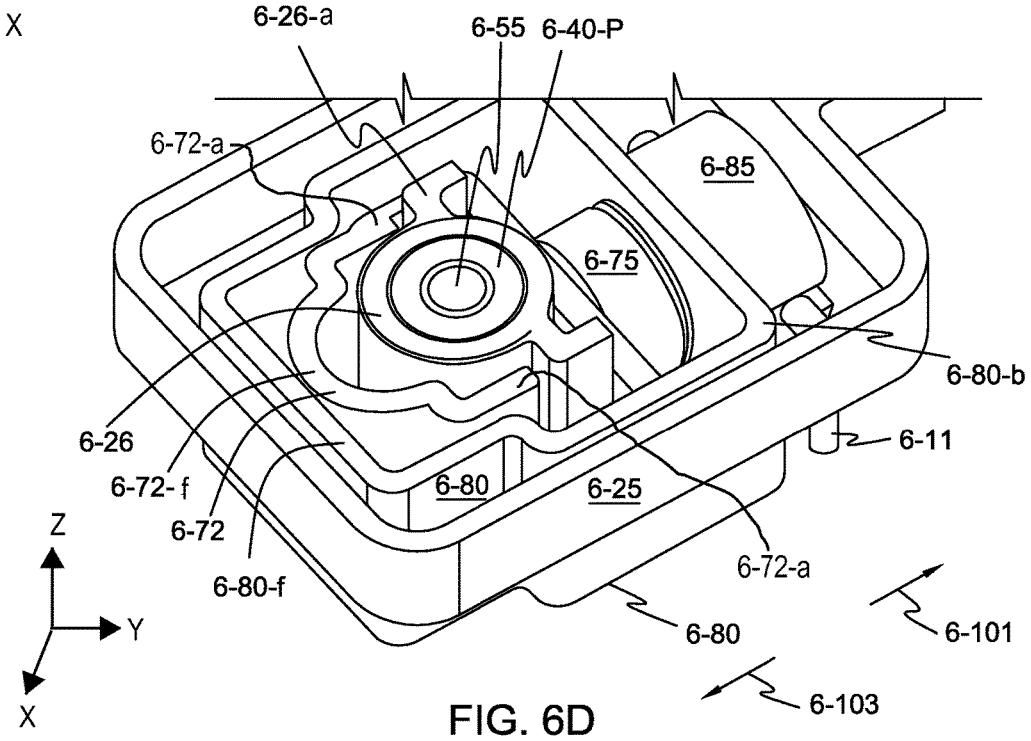
FIG. 6D shows a three dimensional shuttle assembly from a top view in a stovetop fire suppressor in an open activated state, in accordance with an exemplary embodiment of the present invention.

FIG. 6D shows a three dimensional shuttle assembly from a top view of a stovetop fire suppressor in an open activated state, in accordance with an exemplary embodiment of the present invention. The shuttle 6-72 has moved forward 6-103. The center guide 6-26 has dropped to the floor of the shuttle housing 6-80, floor not shown in this view. The charge cup 6-75 has moved forward 6-103 out of the charge housing 6-85 through an opening in the aft wall 6-60-*b* of the shuttle housing 6-80. Upon activation, the front of the shuttle 6-72-*f* moves forward 6-103 and may meet or come near the front wall of the shuttle housing 6-80-*f*. The center pin 6-55 remains centered with respect to the can top wall, not shown. The center pin 6-55 is anchored in the Z direction but is able to pivot about the XZ and YZ planes from the mounting assembly of the fire suppressor, fire suppressor and mounting assembly not shown. The center post 6-40-P circumscribes the pin. The shuttle arm supports 6-72-*a*' move forward 6-103 with the shuttle 6-72. And the center guide arms 6-26-*a* are pushed to the floor of the shuttle housing 6-80 by the compressed spring, spring not shown. The cylinder portion of the center guide 6-26 and the center guide arms 6-26-*a* move as a unit. The center guide 6-26 and the center guide arms 6-26-*a* are integral, in accordance with an exemplary embodiment. A portion of the splash guard 6-25 relative to the vertical, Z direction, is shown for illustrative purposes. In practice, the splash guard 6-25 may extend in the Z direction both above and below the shuttle housing 6-80.

Figure 7A:
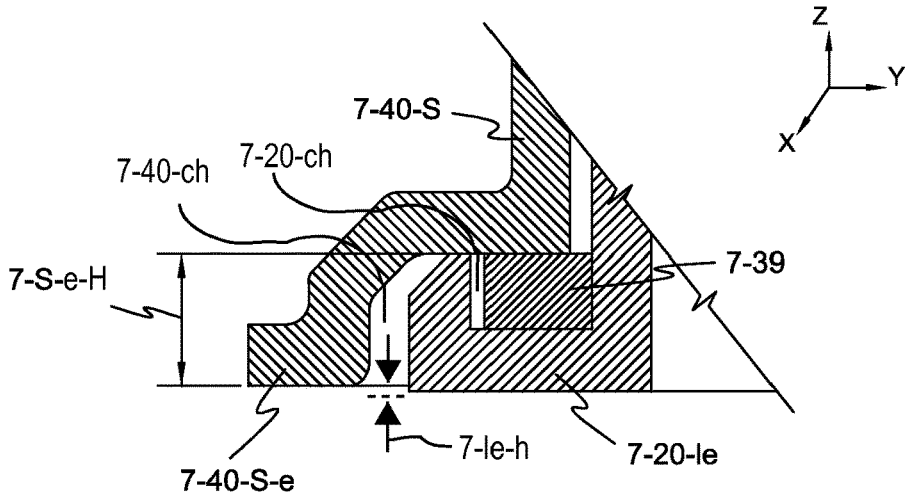
FIG. 7A shows a sidewall edge and a lid edge portion of the closed fire suppressor in FIG. 3A in greater detail, in accordance with an exemplary embodiment of the present invention.
Figure 7B:
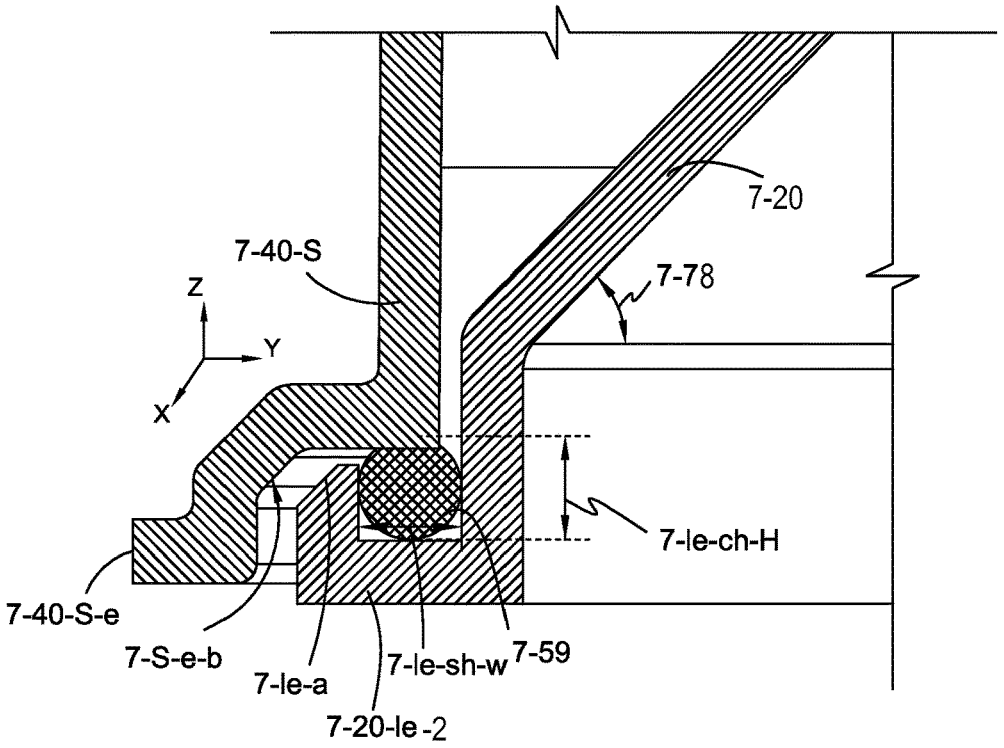
FIG. 7B shows a sidewall edge and a lid edge portion of a closed fire suppressor in greater detail, in accordance with another exemplary embodiment of the present invention.

FIGS. 7A and 7B show the seal portion across the outer circumference of the cone lid and the bottom of the container side wall in more detail, in accordance with respective exemplary embodiments of the present invention. The seal is broken as the shuttle displaces and the spring pushes the bottom lid downward. Further, in accordance with an exemplary embodiment, the bottom sidewall and lid may not contact directly as the o-ring or seal, in accordance with a respective exemplary embodiment, seals the fire suppressor closed across the lid to the sidewall.

Turning to FIG. 7A, The sidewall 7-40-S bends into a sidewall channel 7-40-*ch* and out into the sidewall edge 7-40-S-e. The sidewall bottom edge 7-40-S-e is shown separated from the lid's circumferential edge 7-20-*le* in the Y direction in the closed state. The lid edge forms a channel 7-20-*ch* in which seal 7-39 seats. In accordance with the exemplary embodiment of FIG. 7A, a height of the lid edge channel extends 7-*le-h* just past the height of the side wall edge 7-S-e-H. In accordance with an exemplary embodiment, seal 7-39 has a rectangular cross section and is made from soft closed cell polyethylene foam.

In accordance with the embodiment shown in FIG. 7B, an o-ring 7-59 forms the seal across the sidewall edge 7-40-S-e and lid edge 7-20-*le*. A height 7-*le-ch*-H of the lid edge channel is near that of the o ring 7-59 diameter. A width 7-*le-ch-w* of the lid edge channel may also be near the o ring 7-59 diameter. Lid edge 7-20-*le*-2 has a chamfered outer top edge 7-*le-a* which fits into bend 7-S-e-b of the sidewall edge 7-40-S-e. The side wall 7-40 is integral to the sidewall edge 7-40-S-e configuration. The cone shaped bottom lid 7-20 is integral to the lid edge 7-20-*le* and the cone lid may form an angle 7-76 near 20 degrees with respect to the XY plane.

In accordance with an exemplary embodiment, ridges on an inner side of the can sidewall provide some rigidity to the sidewall. In an alternate embodiment, ridges on an outer side of the can sidewall provide some rigidity to the sidewall. In an alternate embodiment, the container sidewall may have corrugated portions. In yet another alternate embodiment, ribs may be attached to or integral to the can sidewall. The o-ring provides a seal between the bottom sidewall and the outer circumference of the lid.

Figure 8A:
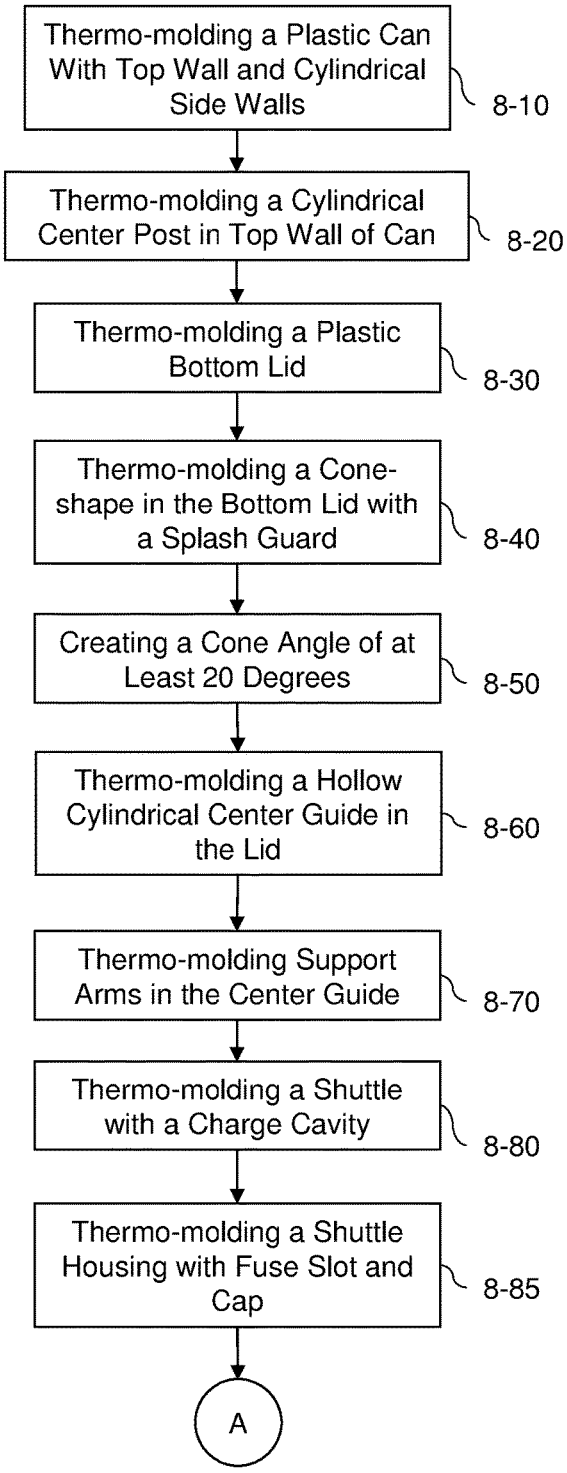
FIGS. 8A and 8B show an exemplary method of manufacturing and an exemplary method of assembling a shuttle actuator stovetop fire suppressor, respectively, in accordance with an exemplary embodiment of the present invention.
Figure 8B:
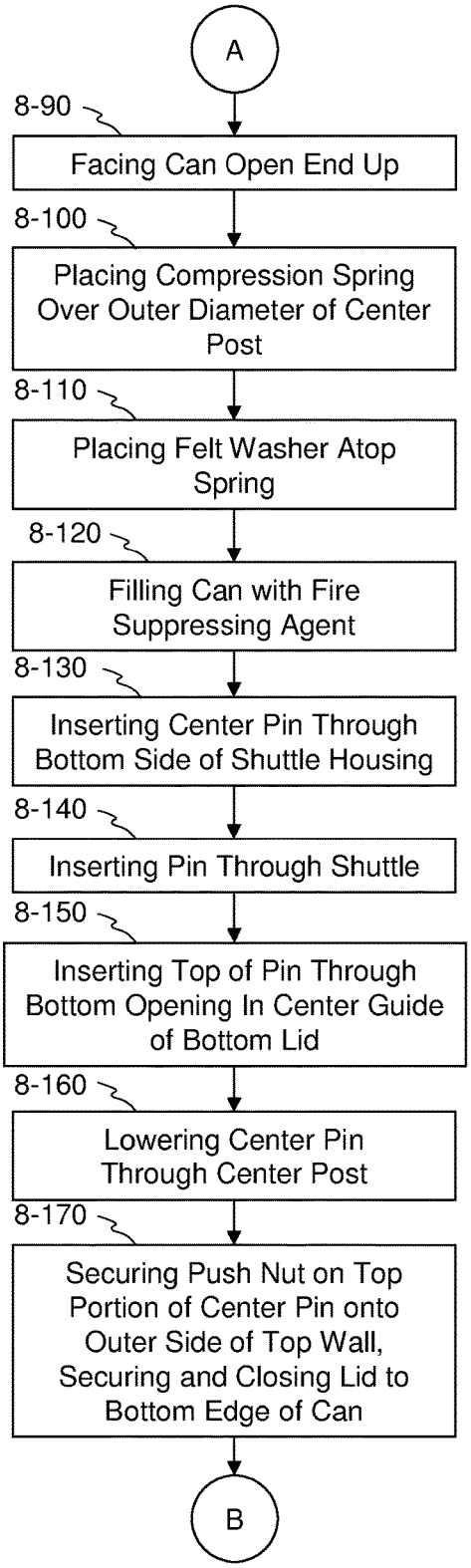

FIGS. 8A and 8B show an exemplary method of manufacturing and an exemplary method of assembling a shuttle actuated stovetop fire suppressor, respectively, in accordance with an exemplary embodiment of the present invention. The combination of the manufacturing, thermo-molding and assembling yields a closed container stovetop fire suppressor with shuttle actuation in accordance with an exemplary method of the present invention. The manufacturing method includes: thermo-molding a plastic can with top wall and a cylindrical side wall 8-10; thermo-molding a cylindrical center post, a center post with hollow center, in a top wall of can 8-20. In accordance with the exemplary embodiment shown, for example, in FIG. 4A, the cylindrical center post is integral to the top wall. Referring again to FIG. 8A, the manufacture method further includes: thermo-molding a cone shaped plastic bottom lid 8-30 with a splash guard; creating a cone angle of at least 20 degrees 8-50; thermo-molding a hollow cylindrical center guide in the lid 8-60; thermo-molding a support arms in the center guide 8-70; thermo-molding a shuttle with a charge cavity 8-80; and thermo-molding a shuttle housing with fuse slot and cap 8-85. In accordance with an exemplary method embodiment, thermo-molding the lid may be a shape other than a cone lid.

Referring to FIG. 8B, the method of assembly includes: facing can open end up 8-90; placing compression spring over outer diameter of center pipe 8-100; placing felt washer atop spring 8-110; and filling can with fire suppressing agent 8-120. The assembly method further includes: inserting the center pin through bottom side of the shuttle housing 8-130; inserting pin through shuttle 8-140; inserting pin through bottom opening in center guide 8-150; lowering the center pin through the center post 8-160; securing a push nut on a top portion of the center pin onto an outer side of top wall, securing and closing the lid to the bottom edge of the can 8-170.

Figure 8C:
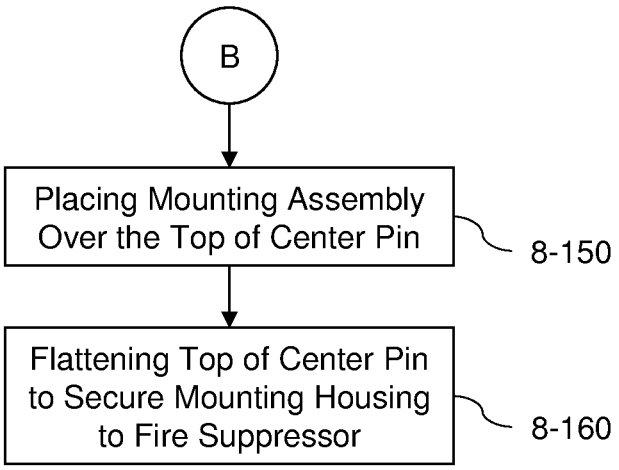
FIGS. 8C and 8D show an exemplary method of assembling a mounting assembly and an exemplary method of assembling an actuator charge in a shuttle assembly, respectively, for a stovetop fire suppressor in accordance with an exemplary embodiment of the present invention.
Figure 8D:
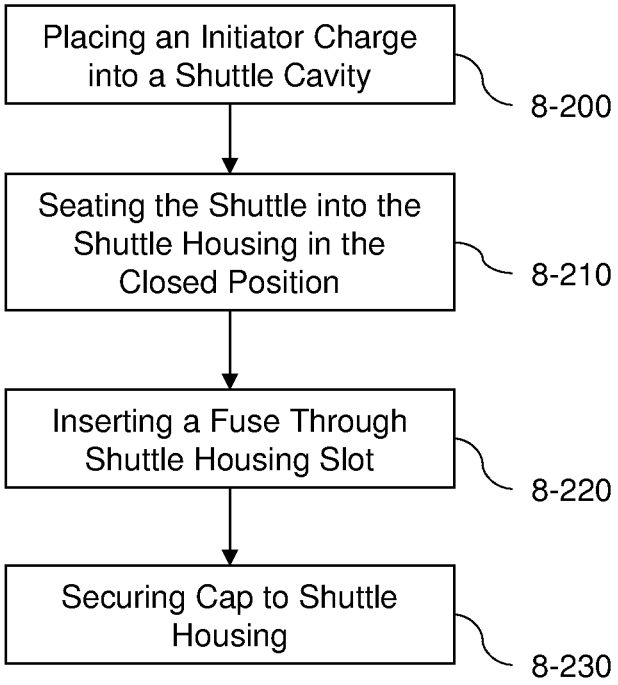

FIGS. 8C and 8D show an exemplary method of assembling a mounting assembly and an exemplary method of assembling an actuator charge in a shuttle assembly, respectively, for a stovetop fire suppressor in accordance with an exemplary embodiment of the present invention. Turning to FIG. 8C, the method includes placing the mounting assembly over the top of the center pin 8-150 and flattening an end of the center pin to secure the mounting housing to the fire suppressor 8-160. Referring to FIG. 8D, an exemplary method of assembling an actuator charge in a shuttle assembly includes: placing an initiator charge into a shuttle cavity 8-200; seating the shuttle into the shuttle housing in the closed position 8-210; inserting a fuse through the shuttle housing slot 8-220; and securing a cap to the shuttle housing at its charge housing end 8-230.

Figure 9:
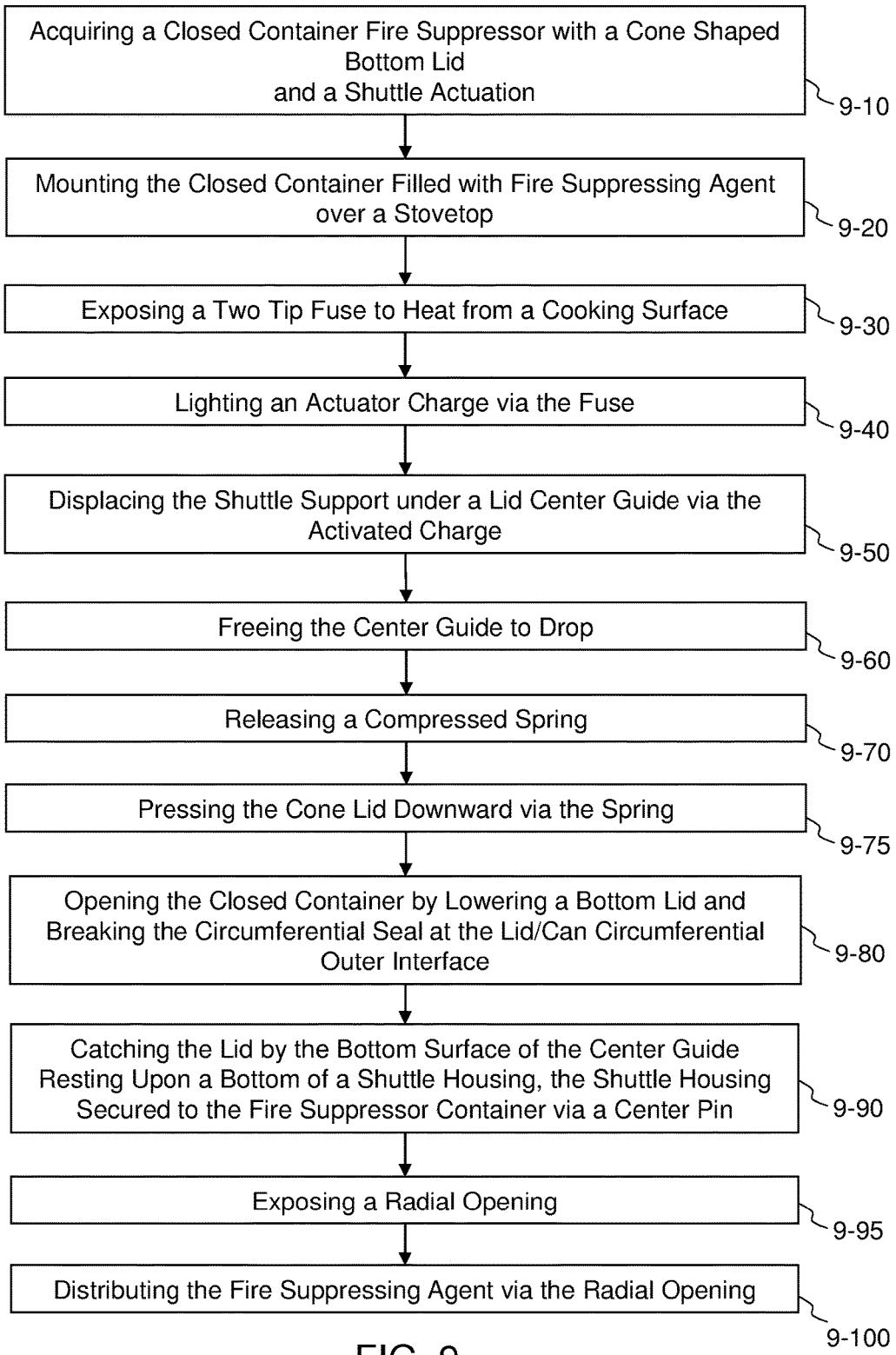
FIG. 9 shows an exemplary method of distributing a fire suppressing agent in a shuttle actuated automatic stovetop fire suppressor, in accordance with an exemplary embodiment of the present invention.

FIG. 9 shows an exemplary method of distributing a fire suppressing agent in a shuttle actuated automatic stovetop fire suppressor, in accordance with the present invention. A method of distributing a fire suppressing agent, in accordance with an exemplary embodiment includes: acquiring a closed container fire suppressor with cone shaped bottom lid and shuttle actuation 9-10; mounting the closed container filled with fire suppressing agent over a stovetop 9-20; exposing a two tip fuse to heat from a cooking surface 9-30; lighting an actuator charge via the fuse 9-40; displacing the shuttle support under a lid center guide via the activated charge 9-50; freeing the center guide to drop 9-60; releasing a compressed spring 9-70; pressing the cone lid downward 9-75; opening closed container by lowering a bottom lid and breaking the circumferential seal at the lid/can outer interface 9-80; catching the lid by its bottom surface of the center guide resting upon a bottom of a shuttle housing, the shuttle housing secured to the fire suppressor container via a center pin 9-90; exposing a radial opening 9-95; and distributing the fire suppressing agent via the radial opening 9-100. Each of these distributing method elements is exemplary.

Figure 10:
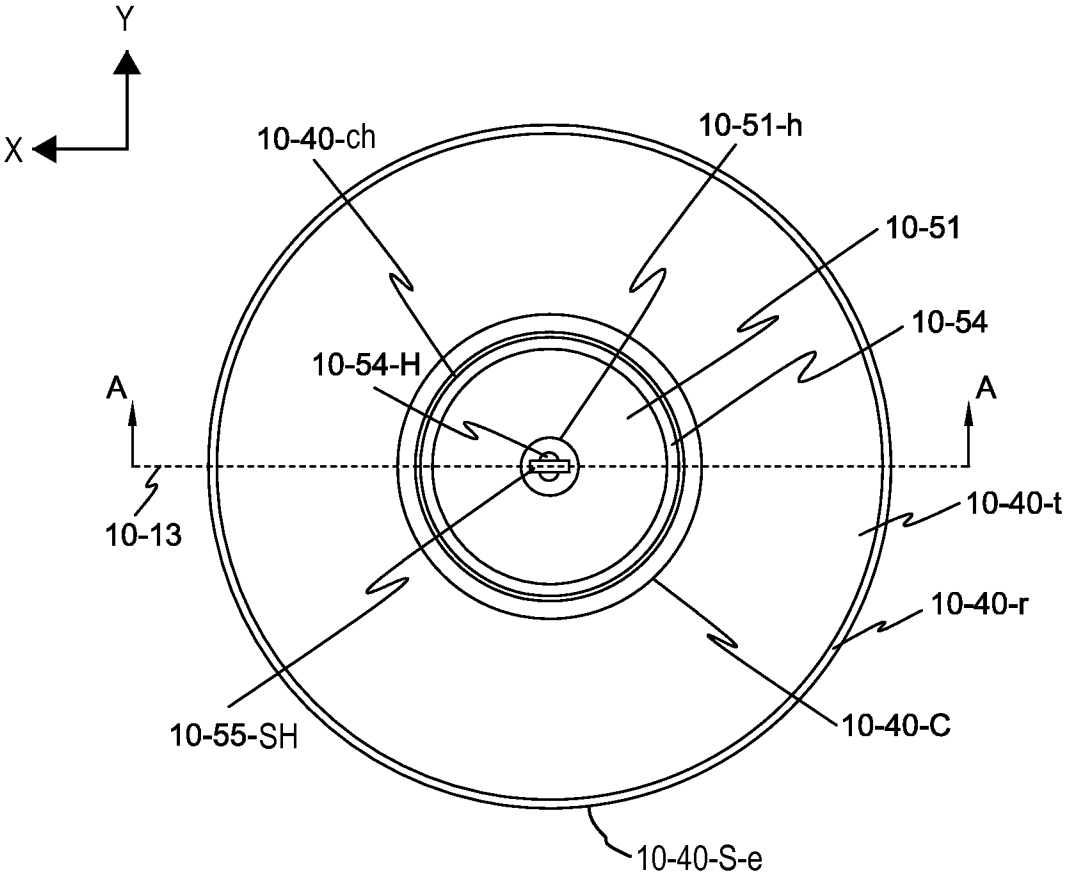
FIG. 10 shows a top view of a stovetop fire suppressor, in accordance with another exemplary embodiment of the present invention.
Figure 11A:
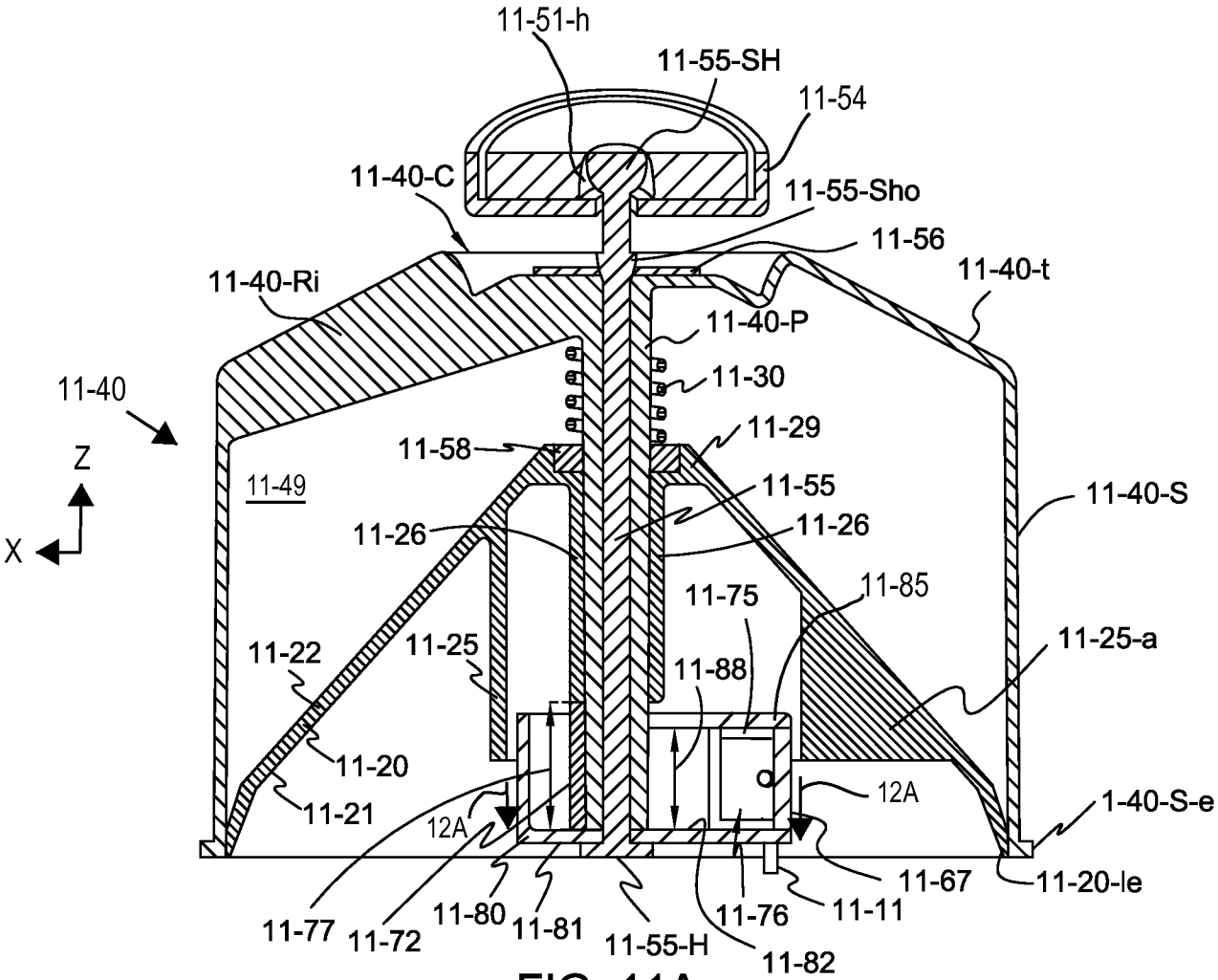
FIG. 11A shows a cross sectional view taken along line A-A of FIG. 10 of a stovetop fire suppressor in a closed state, in accordance with another exemplary embodiment of the present invention
Figure 11B:
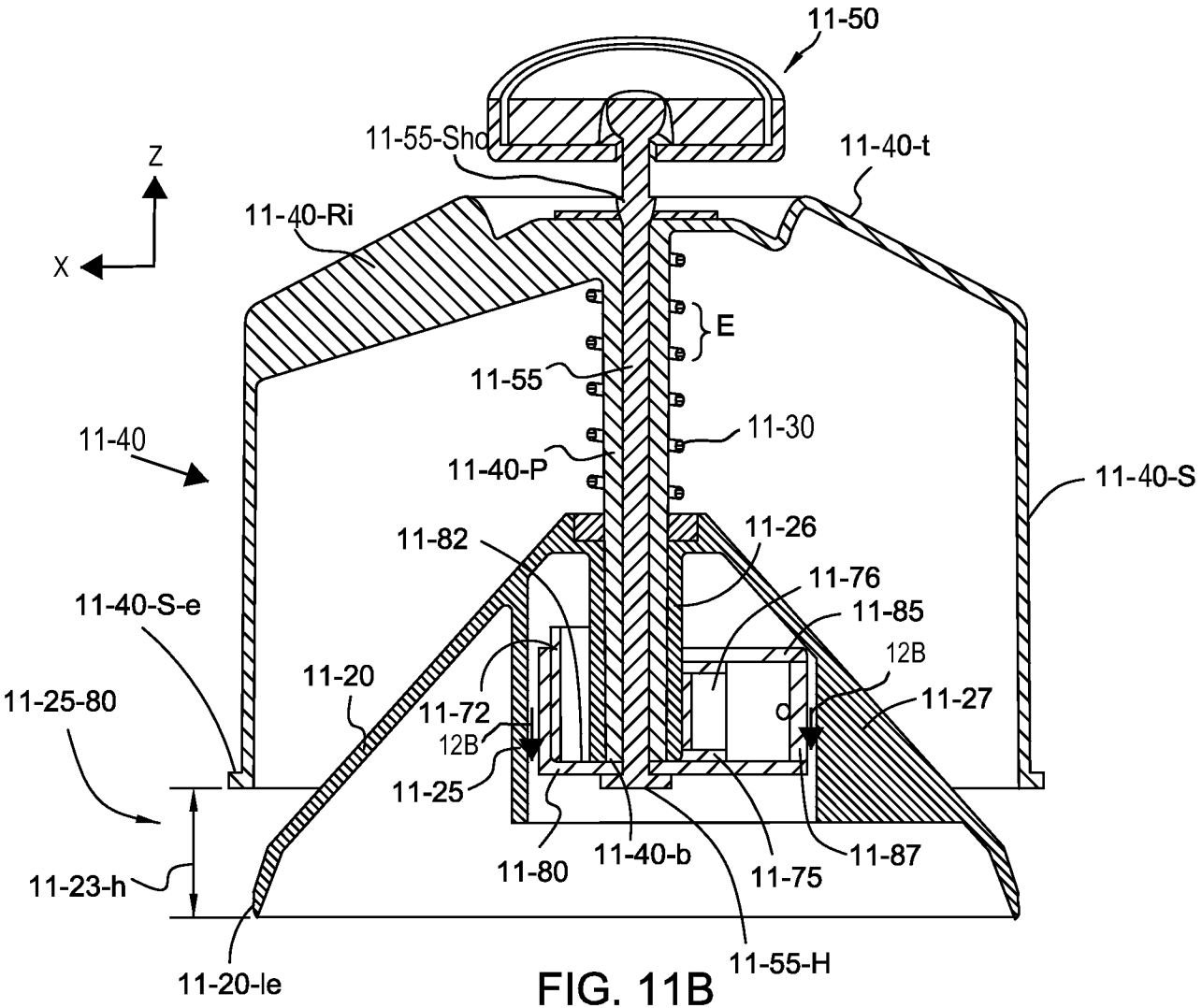
FIG. 11B shows a cross sectional view taken along line A-A of FIG. 10 of a stovetop fire suppressor in an open activated state, in accordance with another exemplary embodiment of the present invention.

FIG. 10 shows a top view of a stovetop fire suppressor, in accordance with another exemplary embodiment of the present invention. Parts of the mounting assembly are shown about the device center, about the shoulder of a center pin 10-55-SH. From the inside, a shoulder of the center pin 10-55-SH is shown extending across a magnet housing hole 10-54-H and within a center hole a magnet 10-51-*h*. A donut shaped magnet 10-51 is mounted in magnet housing 10-54. The magnet housing 10-54 fits within a cup 10-40-C in the top wall. Between cup 10-40-C and magnet housing 10-54 is cup channel 10-40-*ch*. The cup 10-40-C, the cup channel 10-40-*ch* and the magnet housing 10-54 are described in greater detail with reference to, for example, FIGS. 3A and 3B above. Cross sectional views along line A-A 10-13 are shown in FIGS. 11 A and 11B for a closed inactive state and an open active state, respectively. The top wall 10-40-*t* extends outward and rolls 10-40-r into a sidewall, where an outer sidewall edge 10-40-S-e is shown. The outer edge of the side wall 10-40-S-e is shown in more detail in FIGS. 11A and 11B.

FIG. 11A shows a cross sectional view taken along line A-A of FIG. 10 of a stovetop fire suppressor in a closed state, in accordance with another exemplary embodiment of the present invention. This cross sectional view shows the cross section for the XZ plane at axial center. The top wall 11-40-*t* and a cylindrical side wall 11-40-*s* are integral, in accordance with the exemplary embodiment in FIG. 11A. The can top wall 11-40-*t* may be slanted with respect to the horizontal plane XY, as shown in FIG. 11A. The can has an integral cylindrical hollow post 11-40-P which begins from the top wall 11-40-*t*, is centered with respect to the top wall, and extends down into the can 11-40. A compression spring 11-30 surrounds the center post 11-40-P and is shown in its compressed state. Spring 11-30 extends from a top inner surface of a top wall rib 11-40-Ri to felt washer 11-58, in accordance with an exemplary embodiment. Also, in accordance with an exemplary embodiment the center post 11-40-P and rib 11-40-Ri are integral to the top wall. In alternate embodiments, they are separate pieces but secured to the top wall. In accordance with an exemplary embodiment, there may be three ribs 11-40-Ri, each separated by 120 degrees.

FIG. 11A shows a cone shaped bottom lid 11-20 with an inner side 11-22 and an outer side 11-21. Integral to the cone shaped lid 11-20 is a cylindrical center guide 11-26. The center guide 11-26 is centered in the XY plane of the lid and is open in the Z direction. The center guide 11-26 surrounds a bottom portion of center post 11-40-P. The inner diameter of the center guide 11-26 affords easy movement up and down about the outer diameter of center post 11-40-P. In the closed position, the center guide 11-26 sits on the shuttle 11-72.

In accordance with an alternate embodiment, the center guide is a separate piece but is secured to the cone shaped bottom lid. Referring again to FIG. 11A, in accordance with an exemplary embodiment, there is a splash guard 11-25 which surrounds the sides in the XZ and YZ planes of the shuttle housing 11-80. In accordance with the exemplary embodiment of FIG. 11A, the splash guard is integral to the lid and an attachment 11-27 of the splash guard 11-25 to the lid 11-20 is shown in this cross section view on the lid's outer side 11-21. The center guide 11-26 extends down to shuttle 11-72. Shuttle 11-72 is further described with reference to FIGS. 12A-12B. Shuttle 11-72 sits upon inner surface 11-82 of shuttle housing 11-80. Turning to the shuttle 11-72, the shuttle has a charge cup 11-75 forming a charge compartment 11-76 at a fuse 11-11 end. The charge cup 11-75 fits inside a charge housing 11-85. The charge housing 11-85 is integral to the shuttle housing 11-80. Also shown is a cap 11-67, which seals the open end of the charge housing 11-85; and a fuse fits between the cap 11-67 and the charge compartment 11-76. The charge cup 11-75 and the charge housing 11-85 open to the positive XZ plane. The charge cup has a backwall towards the negative XZ plane. The shuttle 11-72 has a height 11-77, which is a little greater than the shuttle housing 11-80 height 11-88.

In accordance with an exemplary embodiment, the outer circumferential lid edge 11-20-*le* and the bottom edge of the container sidewall 11-40-S-e seal by press fit. Through the center of the fire suppressor from the shuttle housing 11-80, through the center post 11-40-P, out the top wall 11-40-*t* and into the magnet housing 11-54 is the center pin 11-55. The center pin top shoulder 11-55-SH fits within a magnet center hole 11-51-*h*. As the shaft of the center pin 11-55 exits the top wall 11-40-*t*, a shoulder 11-55-Sho is flatted to secure the fire suppressor can to the lid in the close position. A washer 11-56 distributes the compression pressure from the shoulder across its surface and inner diameter. In accordance with alternate embodiments, alternate center shafts and fasteners can be used in combination to secure the can 11-40 to the lid 11-20 and support the shuttle housing 11-80. A fire suppressing agent, not shown, is stored in the cavity 11-49 of the can 11-40.

FIG. 11B shows a cross sectional view taken along line A-A of FIG. 10 of a stovetop fire suppressor in an open activated state, in accordance with another exemplary embodiment of the present invention. From the top a shuttle actuated stovetop fire suppressor is attached to a magnetic mounting assembly 11-50. A top wall 11-40-*t* has integral ribs 12-40-Ri for structural support. The top wall 11-40-S rolls down into a cylindrical sidewall 11-40-S. In accordance with an exemplary embodiment, the sidewalls may have some corrugation for structural support, not shown. The spring 11-30 is shown in its extended E state, and in turn, the lid 11-20 is lowered. An opening 11-25-80 is created between the sidewall edge 11-40-S-e and the lid edge 11-20-*le* with a height 11-23-*h*. Fire suppressing powder, not shown, flows out the radial opening 11-25-80.

The center guide 11-26 now sits atop an inside or floor 11-82 of the shuttle housing 11-80. The shuttle 11-72 has been pushed in the X direction by activation of the charge.

The shuttle compartment 11-76 is now shown exited the charge housing 11-85. As in the closed state, of FIG. 11A, the center guide 11-26 circumscribes the center post 11-40-P. The center post 11-40-P is integral to or attached to the top wall 11-40-*t* and runs the height, Z direction, of the can 11-40 with its base 11-40-*b* planted upon the bottom 11-82 of the shuttle housing 11-80. The center pin 11-55 secures the can 11-40 to the shuttle housing 11-80 between its head 11-55-H and its shoulder 11-55-Sho.

Figure 12A:
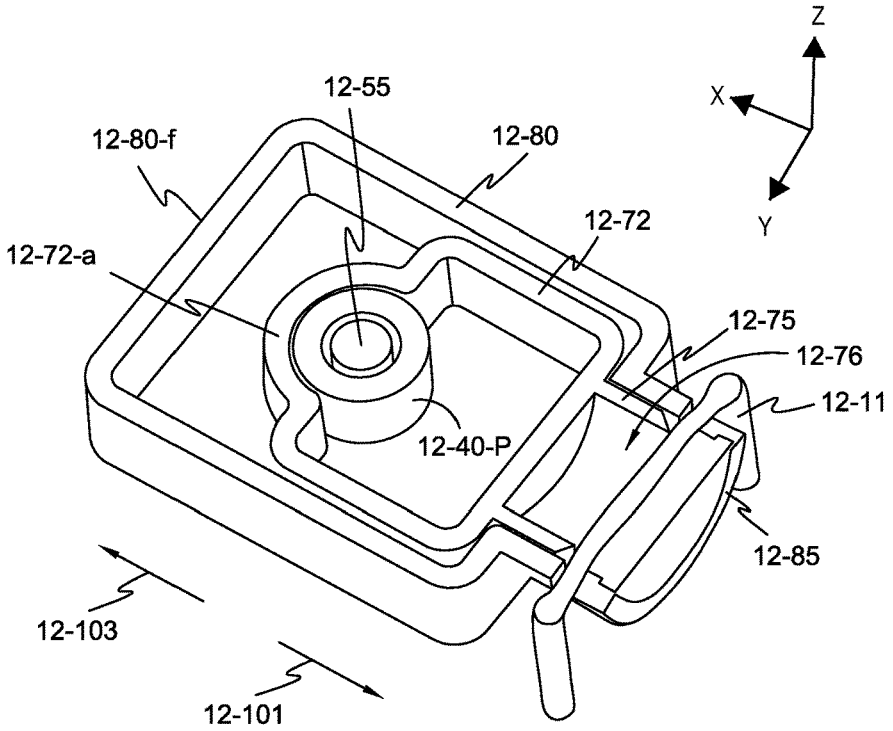
FIG. 12A shows a three dimensional shuttle assembly from a top view in a stovetop fire suppressor in a closed state, in accordance with another exemplary embodiment of the present invention.

FIG. 12A shows a three dimensional shuttle assembly from a top view in a stovetop fire suppressor in a closed state along line 12A-12A shown in FIG. 11A, in accordance with another exemplary embodiment of the present invention. Referring to FIG. 12A, this view, taken at the fuse height 12-11 in the Z direction, shows a shuttle 11-72 in its fire suppressor closed position, aft 12-101. The curve 12-72-a semi-encircles the center post 12-40-P. The center post circumscribes the center pin 11-55. The shuttle charge cup 12-75 is seated in the charge housing 12-85 and forms a charge compartment 12-76. The fuse 12-11 sits across the charge housing 12-85. The curve 12-72-*a* is spaced from the front 11-80-*f* of the shuttle housing 12-80 in the closed state.

Figure 12B:
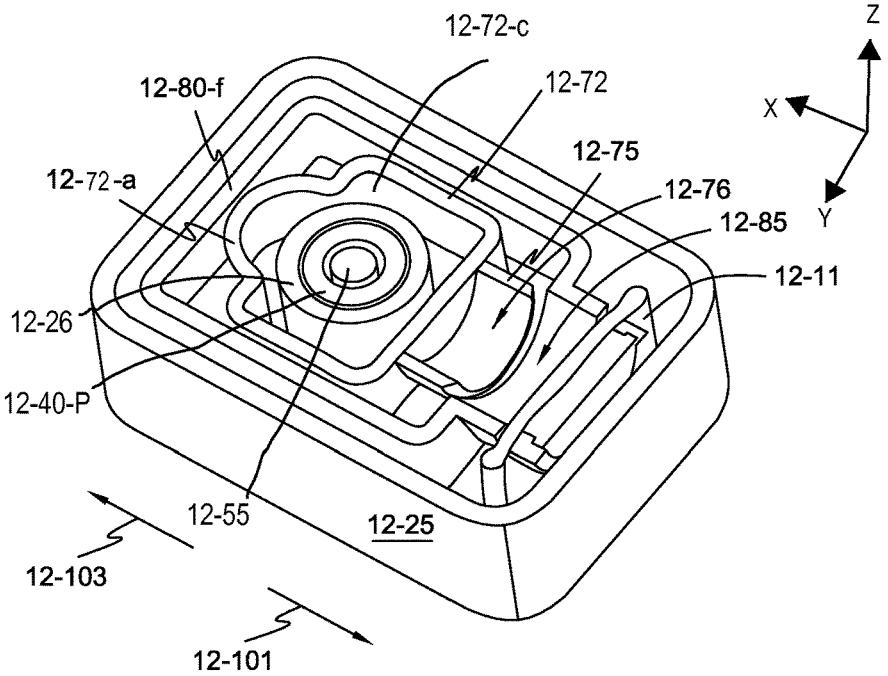
FIG. 12B shows a three dimensional shuttle assembly from a top view in a stovetop fire suppressor in an open activated state, in accordance with another exemplary embodiment of the present invention.

FIG. 12B shows a three dimensional shuttle assembly from a top view in a stovetop fire suppressor in an open activated state along line 12B-12B shown in FIG. 11B, in accordance with another exemplary embodiment of the present invention. This view. Like that in FIG. 12A is taken at the fuse height in the Z direction. Referring again to FIG. 12B, in this view the lid, not shown, and splash guard 12-25 have dropped down, negative Z direction. The splash guard 12-25 encircles the shuttle housing 12-80. The shuttle charge cup 12-75 has move forward 12-103. The shuttle housing stays in its closed state position. The front 12-72-*a* of the shuttle nears the front 12-80-*f* of the shuttle housing. The center guide 12-26 has dropped down within the shuttle's 12-72 hollow center 12-72-*c*. The center guide circumscribes the center post 12-40-P which circumscribes the center pin 12-55, as in the inactivated closed state in FIG. 12A. In application, the fuse would be missing or partially burnt in the open activated state and is shown here for illustrative purposes. The charge is not shown in FIGS. 12A or 12B.

The elements in each of the drawings are provided for illustrative purposes and scaling may be forgone for detail and descriptive purposes. An initiator charge, in accordance with the present invention, may be smaller than an initiator charge for a conventional stovetop fire suppressor. In contrast to conventional stovetop fire suppressors, the present stovetop fire suppressor will activate upon sliding a shuttle which supports a center guide under spring compression, where the shuttle is displaced by activating a small initiator charge. Conventional stovetop fire suppressors utilizing a charge activation mechanism may include those that detach scored metal petals. The charge may be housed within the fire suppressor container itself. Alternate fire suppressors with a charge activation may include breaking a reduced cross sectional area to free a bottom lid. In contrast, the shuttle actuation of the present invention allows for a small charge housed exterior to the fire suppressing agent container.

While specific alternatives to steps of the invention have been described herein, additional alternatives not specifically disclosed but known in the art are intended to fall within the scope of the invention. Thus, it is understood that other applications of the present invention will be apparent to those skilled in the art upon reading the described embodiments and after consideration of the appended drawings.

What is claimed is:

1. An automatic stovetop fire suppressor device with a shuttle actuator, the device comprising:
- a can comprising a top wall and a cylindrical sidewall;
- a plastic bottom lid secured to a bottom of the can and forming a closed container with the can;
- a fire suppressing agent housed in the closed container; and
- a shuttle actuator secured beneath an outer side of the plastic bottom lid,
  - the shuttle actuator comprising:
    - a shuttle charge cavity;
    - a quantity of an explosive used in a single discharge housed in the shuttle charge cavity; and
    - a fuse connected to the single discharge and extending to an exterior of the plastic bottom lid;
- a center shaft extending from the top wall of the can through the plastic bottom lid; and
- a bottom head on the center shaft.

2. The device according to claim 1, further comprising:
- a shuttle housing secured to the outer side of the plastic bottom lid by the bottom head;
  - the shuttle housing having a top open side and a bottom wall; and wherein,
  - the bottom wall of the shuttle housing catches the plastic bottom lid via a center guide upon activation of the fire suppressor device.

3. The device according to claim 1, further comprising:
- a center post integral to the top wall and circumscribing the center shaft.

4. The device according to claim 3, further comprising:
- a center guide circumscribing the center post and extending from a center of and the outer side of the plastic bottom lid.

5. The device according to claim 4, further comprising:
- a compression spring extending from the top wall to a top of the center guide and circumscribing the center post.

6. An automatic stovetop fire suppressor device with shuttle actuator, the device comprising:
- a thermo-molded plastic can comprising a top wall and a cylindrical sidewall;
- a plastic cone shaped bottom lid secured to a bottom of the can and forming a closed container with the can;
- a fire suppressing agent housed in the closed container;
- a center guide secured to the plastic cone shaped bottom lid and extending down to a shuttle;
- a helical compression spring positioned above the center guide;
- a quantity of an explosive used in a single discharge housed in a charge cup; and
- wherein, activation of the quantity of explosive displaces the shuttle and the helical compression spring pushes the plastic cone shaped bottom lid free from the bottom of the can exposing a radial opening.

7. The device according to claim 6, further comprising:
- a cylindrical center post centered across the top wall and affixed to the top wall.

8. The device according to claim 7, wherein:
- the cylindrical center post is integral to the top wall.

9. The device according to claim 6, wherein:
- the cone shaped bottom lid is made of thermo-molded plastic.

10. The device according to claim 6, wherein:

the center guide is integral to the bottom lid, is centered in the bottom lid, and extends from a top and a center of the bottom lid.

11. The device according to claim 8, wherein:

the helical compression spring circumscribes the center post.

12. The device according to claim 8, further comprising:

a shuttle housing, housing the shuttle with an open top face and a bottom wall;

a center shaft passing through shuttle housing, rising through the center post, and securing the fire suppressor in a closed position.

13. The device according to claim 12, further comprising:

a fuse passing along the quantity of explosive in the charge cup; and a first and a second end of the fuse extending downward to an exterior of the fire suppressor.

14. The device according to claim 12, wherein:

the center shaft is a headed pin.

15. The device according to claim 7, wherein:

the center guide has an inner diameter surrounding an outer diameter of the center post and comprises a vertical key or extensions that rest upon the shuttle.

16. The device according to claim 7, wherein:

the center guide has an inner diameter surrounding an outer diameter of the center post and is positioned beneath the spring, and is secured to the bottom lid.

17. The device according to claim 6, further comprising:

a splash guard centered across and attached to an outer side of the bottom lid.

* * * * *